US009500107B2

(12) United States Patent
Takahata et al.

(10) Patent No.: US 9,500,107 B2
(45) Date of Patent: Nov. 22, 2016

(54) CONTROL SYSTEM FOR ENGINE

(71) Applicant: Mazda Motor Corporation, Aki-gun, Hiroshima (JP)

(72) Inventors: Tatsuya Takahata, Hiroshima (JP); Keiichi Miyamoto, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 14/637,273

(22) Filed: Mar. 3, 2015

(65) Prior Publication Data

US 2015/0275710 A1 Oct. 1, 2015

(30) Foreign Application Priority Data

Mar. 31, 2014 (JP) ..... 2014-072520

(51) Int. Cl.

| | |
|---|---|
| ***F01L 9/02*** | (2006.01) |
| ***F01L 1/34*** | (2006.01) |
| ***F01L 1/24*** | (2006.01) |
| ***F01L 1/344*** | (2006.01) |
| ***F01L 13/00*** | (2006.01) |
| ***F01M 1/16*** | (2006.01) |

(52) U.S. Cl.

CPC ..... *F01L 9/02* (2013.01); *F01L 1/2405* (2013.01); *F01L 1/34* (2013.01); *F01L 1/3442* (2013.01); *F01L 13/0005* (2013.01); *F01M 1/16* (2013.01); *F01L 2013/001* (2013.01)

(58) Field of Classification Search

CPC ..... F01L 1/34; F01L 1/3442; F01L 9/02; F01L 13/0005; F01L 2013/001

USPC ..... 123/90.12, 90.17

See application file for complete search history.

(56) References Cited

U.S. PATENT DOCUMENTS 8,991,347 B2 * 3/2015 Miyamoto ..... F01L 1/3442 123/90.12

FOREIGN PATENT DOCUMENTS

JP 2013104376 A 5/2013

* cited by examiner

*Primary Examiner* — Ching Chang

(74) *Attorney, Agent, or Firm* — Alleman Hall McCoy Russell & Tuttle LLP

(57) ABSTRACT

A control system for an engine is provided. The system includes a hydraulically-operated variable valve timing mechanism, a variable oil pump, and a hydraulic-pressure control valve. The variable valve timing mechanism has advance-side and retard-side operation chambers and a locking mechanism. The system includes a hydraulic-pressure sensor for detecting hydraulic pressure within a hydraulic-pressure path, and a pump control device for performing a target hydraulic-pressure control. During a change of an engine operating state in a specific operation of the engine, while an unlocking operation of a locking member of the locking mechanism is performed, the pump control device performs, instead of the target hydraulic-pressure control, a discharge amount restricting control to control the hydraulic pressure to be an upper-limit hydraulic-pressure value or lower, which is an upper limit to perform the unlocking operation.

6 Claims, 16 Drawing Sheets

CONTROL SYSTEM FOR ENGINE

BACKGROUND

The present invention relates to a control system for an engine, which includes a hydraulically-operated variable valve timing mechanism and a variable oil pump. The hydraulically-operated variable valve timing mechanism has advance-side and retard-side operation chambers for changing a phase angle of a camshaft with respect to a crankshaft by supplying hydraulic pressure, and a locking mechanism which unlocks, by supplying hydraulic pressure, a locking member for fixing the phase angle of the camshaft with respect to the crankshaft. The variable oil pump supplies oil to hydraulically-operated devices including the variable timing mechanism of the engine via a hydraulic-pressure path.

JP2013-104376A discloses a valve timing control system. The control system is provided with a variable valve timing mechanism, an oil pump, and a hydraulic-pressure control valve. The variable valve timing mechanism has advance-side and retard-side operation chambers and a locking mechanism. The advance-side and retard-side operation chambers are formed by a housing for rotating in cooperation with a crankshaft of an engine and a vane body for integrally rotating with a camshaft, and changing the phase angle of the camshaft with respect to the crankshaft by supplying hydraulic pressure. The locking mechanism unlocks, by supplying hydraulic pressure, a locking member for fixing a phase angle of the camshaft with respect to the crankshaft. The oil pump supplies oil to the variable valve timing mechanism. The hydraulic-pressure control valve controls the hydraulic-pressure to be supplied to the locking mechanism and the advance-side and retard-side operation chambers of the variable valve timing mechanism. Further, when changing a phase angle of the variable valve timing mechanism, the hydraulic pressure is calculated before and after being controlled by the hydraulic-pressure control valve, and based on the calculated values, a timing of the hydraulic pressure control by the hydraulic-pressure control valve is retarded. Thus, in the variable valve timing mechanism, unlocking failure of the locking member of the locking mechanism can be reduced.

However, in JP2013-104376A, since the timing of the hydraulic-pressure control by the hydraulic-pressure control valve is retarded when changing the phase angle of the variable valve timing mechanism as described above, there is a disadvantage in that a phase angle control suitable for an operating state of the engine cannot be performed.

SUMMARY

The present invention is made in view of the above situations and aims to reduce an unlocking failure of a locking member of a locking mechanism of a variable valve timing mechanism, while performing a phase angle control suitable for an operating state of an engine.

To reduce such an unlocking failure, in the present invention, during a change of an operating state of an engine in a specific operation of the engine in which a locking member of a locking mechanism of a variable valve timing mechanism is in a locked state, while an unlocking operation of the locking member is performed, an oil discharge amount of a variable oil pump is restricted so that the hydraulic pressure becomes an upper-limit hydraulic-pressure value or lower.

Specifically, according to one aspect of the present invention, a control system for an engine is provided. The control system includes a hydraulically-operated variable valve timing mechanism, a variable oil pump, and a hydraulic-pressure control valve. The hydraulically-operated variable valve timing mechanism has advance-side and retard-side operation chambers that are formed by a housing for rotating in cooperation with a crankshaft of the engine and a vane body for integrally rotating with a camshaft, and changing a phase angle of the camshaft with respect to the crankshaft by supplying hydraulic pressure, and a locking mechanism that unlocks, by supplying hydraulic pressure, a locking member for fixing the phase angle of the camshaft with respect to the crankshaft. The variable oil pump supplies, via a hydraulic-pressure path, oil to hydraulically-operated devices including the variable valve timing mechanism of the engine. The hydraulic-pressure control valve controls the hydraulic pressure to be supplied to the locking mechanism and the advance-side and retard-side operation chambers. The control system has the following configuration.

That is, the control system includes a hydraulic-pressure sensor for detecting the hydraulic pressure within the hydraulic-pressure path, and a pump control device for performing a target hydraulic-pressure control for controlling an oil discharge amount of the variable oil pump to control the hydraulic pressure that is to be detected by the hydraulic-pressure sensor to be a target hydraulic pressure set according to an operating state of the engine. During a change of the operating state of the engine in a specific operation of the engine in which the locking member of the locking mechanism is in a locked state, while an unlocking operation of the locking member is performed, the pump control device performs, instead of the target hydraulic-pressure control, a discharge amount restricting control for restricting the oil discharge amount of the oil pump to control the hydraulic pressure that is to be detected by the hydraulic-pressure sensor to be an upper-limit hydraulic-pressure value or lower, the upper-limit hydraulic-pressure value being an upper limit for the unlocking operation of the locking member to be performed.

According to this configuration, the pump control device performs the target hydraulic-pressure control for controlling the oil discharge amount of the variable oil pump to control the hydraulic pressure that is to be detected by the hydraulic-pressure sensor to be the target hydraulic pressure set according to the operating state of the engine. Thus, a suitable phase angle control according to the operating state of the engine can be performed.

Incidentally, during the change of the operating state of the engine (e.g., during an increase of the engine load) in the specific operation of the engine (e.g., in an idle operation of the engine), the supplied hydraulic pressure from the variable oil pump is increased with high responsiveness by the control of the oil discharge amount of the variable oil pump described above. Therefore, during the change of the operating state of the engine in the specific operation of the engine in which the locking member of the locking mechanism of the variable valve timing mechanism is in the locked state, if the locking member is unlocked in the state where the oil is charged into the advance-side and retard-side operation chambers of the variable valve timing mechanism, the oil is supplied to either one of the advance-side and retard-side operation chambers at a high hydraulic pressure due to the control of the hydraulic-pressure control valve. Thus, there may be a case where the vane body attempts to turn while unlocking the locking member, the turning force of the vane body acts on the locking member as a shearing force, and the locking member cannot be unlocked.

Here, during the change of the operating state of the engine in the specific operation of the engine in which the locking member of the locking mechanism of the variable valve timing mechanism is in the locked state, while the unlocking operation of the locking member is performed, the pump control device performs, instead of the target hydraulic-pressure control, the discharge amount restricting control for restricting the oil discharge amount of the variable oil pump to control the hydraulic pressure that is to be detected by the hydraulic-pressure sensor to be the upper-limit hydraulic-pressure value or lower, which is the upper limit for the unlocking operation of the locking member to be performed. Thus, the unlocking failure of the locking member can be reduced.

As described above, the unlocking failure of the locking member of the locking mechanism of the variable valve timing mechanism can be reduced while performing the suitable phase angle control according to the operating state of the engine.

The control system may also include a cam angle sensor for detecting a rotational phase of the camshaft. When an engine load is increased in the change of the engine operating state during the specific operation of the engine, while the unlocking operation of the locking member of the locking mechanism is performed, the pump control device may determine, based on the detection information from the cam angle sensor, whether the unlocking operation of the locking member is completed, and until the unlocking operation of the locking member is determined to be completed, the pump control device may perform the discharge amount restricting control instead of the target hydraulic-pressure control.

According to this configuration, when the engine load is increased in the specific operation of the engine, while the unlocking operation of the locking member of the locking mechanism of the variable valve timing mechanism is performed, the pump control device determines, based on the detection information from the cam angle sensor, whether the unlocking operation of the locking member is completed, and until the unlocking operation of the locking member is determined to be completed, the pump control device performs the discharge amount restricting control instead of the target hydraulic-pressure control. Thus, the hydraulic pressure to be detected by the hydraulic-pressure sensor can surely be the upper-limit hydraulic-pressure value or lower, which is the upper limit for the unlocking operation of the locking member to be performed, until the unlocking operation of the locking member is completed. Therefore, the unlocking failure of the locking member can surely be reduced.

When the engine load is increased in the change of the engine operating state during the specific operation of the engine, the pump control device may perform the discharge amount restricting control instead of the target hydraulic-pressure control for a predetermined period of time from the start of the unlocking operation of the locking member of the locking mechanism.

According to the above configuration, when the engine load is increased in the specific operation of the engine, the pump control device performs the discharge amount restricting control instead of the target hydraulic-pressure control for the predetermined time period from the start of the unlocking operation of the locking member of the locking mechanism of the variable valve timing mechanism. Thus, the unlocking failure of the locking member can be reduced with a simple configuration using a timer.

The hydraulically-operated devices may also include a hydraulically-operated valve stopping mechanism for performing a reduced-cylinder operation of the engine by supplying the hydraulic pressure to suspend one or more of cylinders of the engine, the one or more of the cylinders being less than all the cylinders. In the reduced-cylinder operation of the engine, the pump control device may perform the target hydraulic-pressure control to control the hydraulic pressure that is to be detected by the hydraulic-pressure sensor to be a target hydraulic pressure higher than a required hydraulic pressure of the valve stopping mechanism.

According to this configuration, the valve stopping mechanism performs the reduced-cylinder operation of the engine by supplying the hydraulic pressure to suspend one or more of the cylinders of the engine, the one or more of the cylinders being less than all the cylinders. Moreover, in the reduced-cylinder operation of the engine, the pump control device performs the target hydraulic-pressure control to control the hydraulic pressure that is to be detected by the hydraulic-pressure sensor to be the target hydraulic pressure higher than the required hydraulic pressure of the valve stopping mechanism. Thus, the valve stopping mechanism can be stably operated and the reduced-cylinder operation can be maintained stable. Therefore, fuel consumption can be improved.

DETAILED DESCRIPTION OF EMBODIMENTS

Hereinafter, one embodiment of the present invention is described in detail with reference to the appended drawings.

Figure 1:
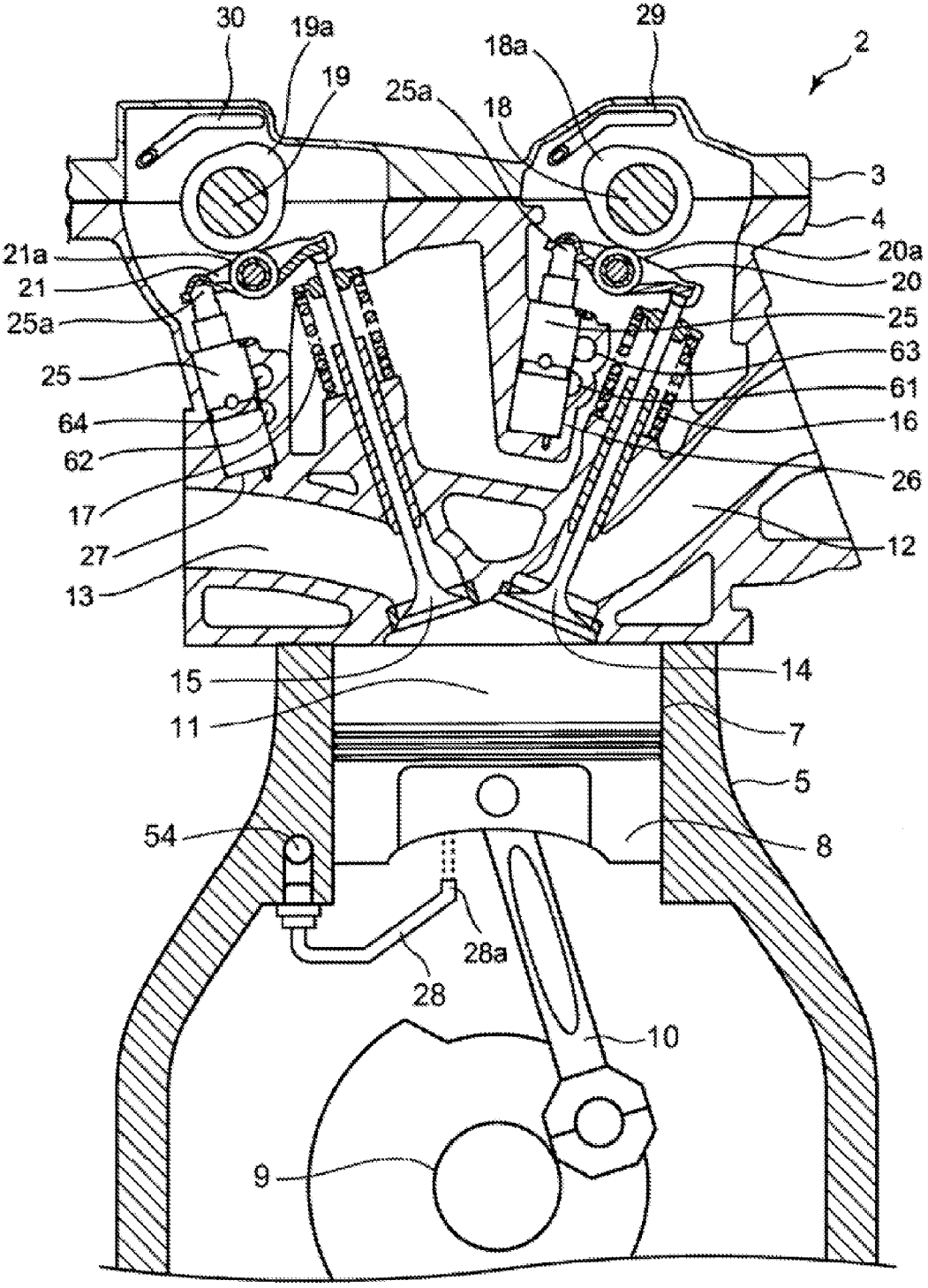
FIG. 1 is a cross-sectional view illustrating a schematic configuration of an engine provided with a hydraulically-operated variable valve timing mechanism of a control system according to one embodiment of the present invention.

FIG. 1 illustrates an engine 2 provided with a hydraulically-operated variable valve timing mechanism, controlled by a control system according to this embodiment of the present invention. The engine 2 of this embodiment is an inline four-cylinder gasoline engine in which the first to fourth cylinders are aligned in this order in a direction perpendicular to the planar section of FIG. 1, and is installed in a vehicle, such as an automobile. In the engine 2, a cam cap 3, a cylinder head 4, a cylinder block 5, a crank case (not illustrated), and an oil pan 6 (see FIG. 6) are coupled in vertical directions of the engine 2, pistons 8 that are respectively reciprocatable within four cylinder bores 7 formed in the cylinder block 5 are coupled, by connecting rods 10, to a crankshaft 9 that is rotatably supported by the crank case, and combustion chambers 11 are formed, one for each cylinder, by the cylinder bore 7 of the cylinder block 5, the pistons 8, and the cylinder head 4.

Intake ports 12 and exhaust ports 13 opening to the combustion chambers 11 are formed in the cylinder head 4, and the intake valves 14 and exhaust valves 15 for opening and closing the intake ports 12 and the exhaust ports 13 are respectively attached to the intake ports 12 and the exhaust ports 13. The intake and exhaust valves 14 and 15 are respectively biased to their closing directions (upward direction in FIG. 1) by return springs 16 and 17. Cam followers 20*a* and 21*a* rotatably provided in substantially center parts of swing arms 20 and 21, respectively, are pushed downward by cam parts 18*a* and 19*a* formed in the outer circumferences of rotatable camshafts 18 and 19, to swing the swing arms 20 and 21 by having, as supporting points, top portions of the respective pivot mechanisms 25*a*, each provided to one end part of the corresponding swing arm (20 or 21). Thus, the intake and exhaust valves 14 and 15 are pushed downward by the other end parts of the swing arms 20 and 21 against biasing forces of the return springs 16 and 17, and open.

A well-known hydraulic lash adjuster 24 (hereinafter, abbreviated to the HLA 24) for automatically adjusting a valve clearance to zero by using an oil pressure is provided as a pivot mechanism (having a similar configuration to the pivot mechanism 25*a* of a later-described HLA 25) of each of the swing arms 20 and 21 of the second and third cylinders located in the central area of the engine 2 in the cylinder-row direction. Note that, the HLA 24 is only illustrated in FIG. 6.

Moreover, the HLA 25 with a valve stopping mechanism (hereinafter, may simply be referred to as the HLA 25) having the pivot mechanism 25*a* is provided for each of the swing arms 20 and 21 of the first and fourth cylinders located in both end areas of the engine 2 in the cylinder-row direction. The HLA 25 can automatically adjust the valve clearance to zero similarly to the HLA 24. Additionally, the HLA 25 stops the operations (open/close operations) of the intake and exhaust valves 14 and 15 of the first and fourth cylinders in a reduced-cylinder operation in which operations of the first and fourth cylinders among all the cylinders of the engine 2 are suspended, whereas the HLA 25 activates the intake and exhaust valves 14 and 15 of the first and fourth cylinders (causing them to perform the open/close operations) in an all-cylinder operation in which all the cylinders (four cylinders) are operated. The intake and exhaust valves 14 and 15 of the second and third cylinders are operated in both of the reduced-cylinder operation and the all-cylinder operation. Therefore, in the reduced-cylinder operation, only the operations of the intake and exhaust valves 14 and 15 of the first and fourth cylinders among all the cylinders of the engine 2 are stopped, and in the all-cylinder operation, the intake and exhaust valves 14 and 15 of all the cylinders are operated. Note that, the reduced-cylinder operation and the all-cylinder operation are switched therebetween according to an operating state of the engine 2 as described later.

Attaching holes 26 and 27 are formed in intake and exhaust parts of the cylinder head 4 corresponding to the first and fourth cylinders. A lower end part of the HLA 25 is attached to each of the attaching holes 26 and 27 by being inserted thereinto. Moreover, attaching holes similar to the attaching holes 26 and 27 are formed in intake and exhaust parts of the cylinder head 4 corresponding to the second and third cylinders. A lower end part of the HLA 24 is attached to each of the attaching holes by being inserted thereinto. Further, oil paths 61 to 64 are bored in the cylinder head 4. The two oil paths 61 and 63 communicate with the attaching hole 26 for the HLA 25, and the two oil paths 62 and 64 communicate with the attaching hole 27 for the HLA 25. In the state where the HLAs 25 are fitted into the attaching holes 26 and 27, the oil paths 61 and 62 supply the oil pressure (operating pressure) for operating later-described valve stopping mechanisms 25*b* (see FIGS. 2A, 2B and 2C) of the HLAs 25, and the oil paths 63 and 64 supply the oil pressure for the pivot mechanisms 25*a* of the HLAs 25 to automatically adjust the valve clearance to zero. Note that, the oil paths 63 and 64 only communicate with the attaching holes for the HLA 24. The oil paths 61 to 64 are described later with reference to FIG. 6.

The cylinder block 5 is formed with a main gallery 54 extending within the exhaust-side walls of the cylinder bores 7 in the cylinder-row direction. A piston-cooling oil jet 28 (oil injection valve) communicating with the main gallery 54 is provided near a lower end of the main gallery 54 for each piston 8. The oil jet 28 has a nozzle portion 28*a* disposed below the piston 8 so that the nozzle portion 28*a* injects engine oil (hereinafter, simply referred to as oil) toward a back face of a top part of the piston 8.

Oil showers 29 and 30 formed by pipes are respectively provided above the camshafts 18 and 19 so that a lubricating oil drops, from the oil showers 29 and 30, to the cam parts 18*a* and 19*a* of the camshafts 18 and 19, which are respectively located below the oil showers 29 and 30, and also to, further below, contacting portions between the swing arm 20 and the cam follower 20*a* and between the swing arm 21 and the cam follower 21*a*, respectively.

Next, the valve stopping mechanisms 25*b* serving as one of the hydraulically-operated devices are described with reference to FIGS. 2A, 2B and 2C. The valve stopping mechanisms 25*b* stop, by using the oil pressure, the operation of at least one of the intake and exhaust valves 14 and 15 (in this embodiment, both valves) of each of the first and fourth cylinders among all the cylinders of the engine 2, according to the operating state of the engine 2. Thus, when the operation mode of the engine is switched to the reduced-cylinder operation according to the operating state of the engine 2, the open/close operations of the intake and exhaust valves 14 and 15 of the first and fourth cylinders are stopped by the valve stopping mechanisms 25*b*, and when the operation mode of the engine is switched to the all-cylinder operation, the valve stopping operation by the valve stopping mechanisms 25*b* is not performed, and the open/close operations of the intake and exhaust valves 14 and 15 of the first and fourth cylinders are performed.

In this embodiment, each of the valve stopping mechanisms 25*b* is provided in the HLA 25. Thus, the HLA 25 includes the pivot mechanism 25*a* and the valve stopping mechanism 25*b*. The pivot mechanism 25*a* has substantially the same configuration as the pivot mechanism of the well-known HLA 24, in which the valve clearance is automatically adjusted to zero by using the oil pressure.

Figure 2C:
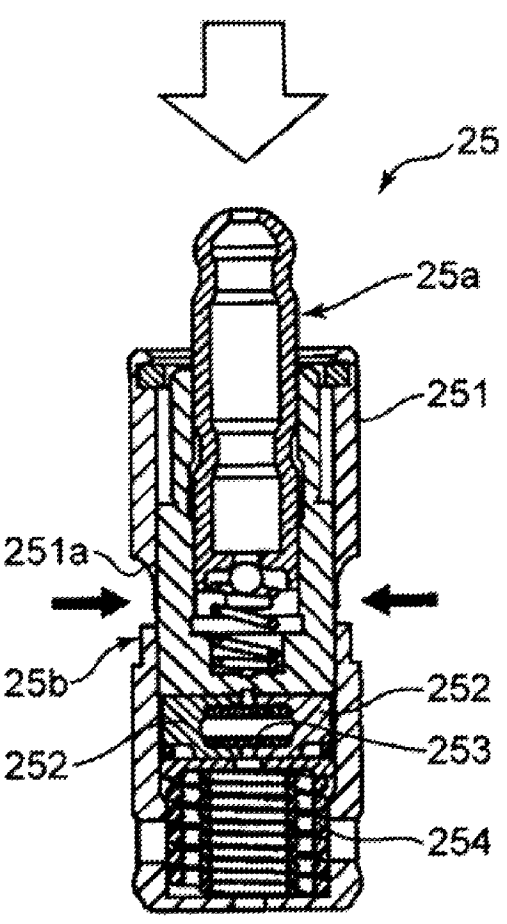
FIGS. 2A to 2C are cross-sectional views illustrating configuration and operation states of a hydraulically-operated valve stopping mechanism.
Figure 2B:
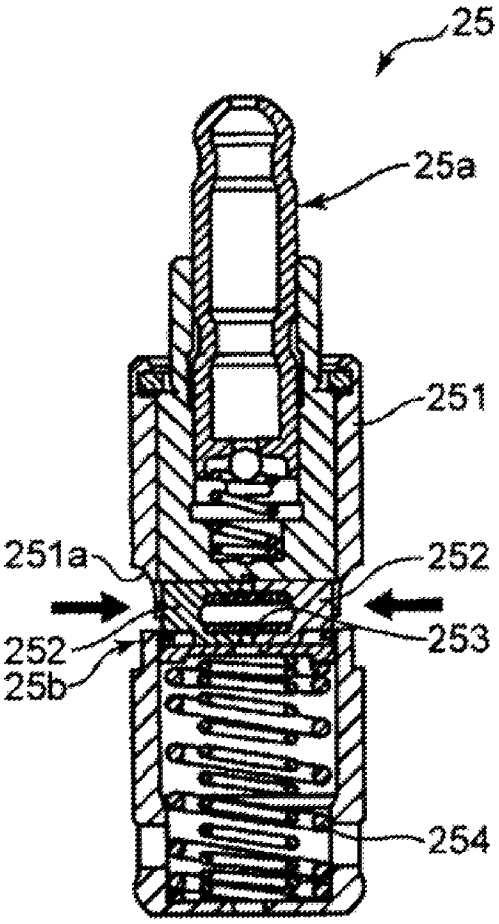
Figure 2A:
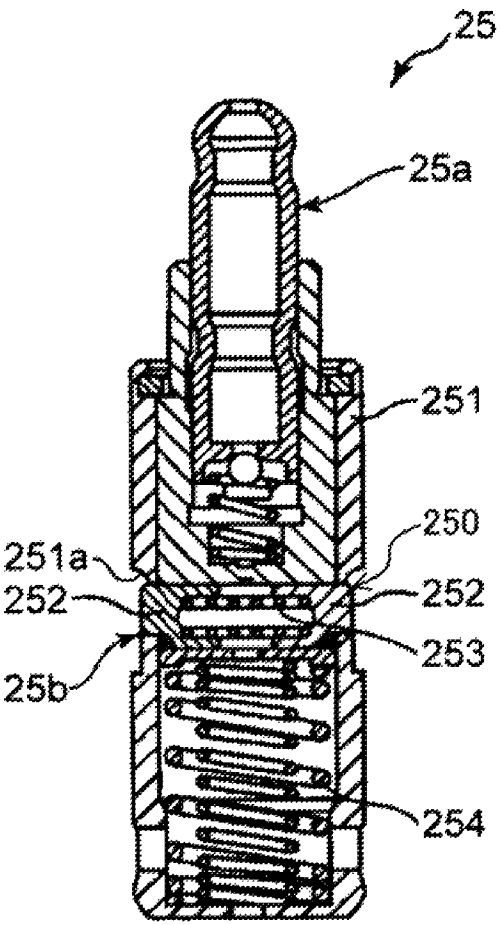

As illustrated in FIG. 2A, the valve stopping mechanism 25*b* is provided with a locking mechanism 250 for locking the operation of the pivot mechanism 25*a*. The locking mechanism 250 includes a pair of lock pins 252 provided to be able to enter into and exit from two penetrating holes 251*a*. The penetrating holes 251*a* are formed in a circumferential side face of an outer cylinder 251 with a bottom, to face each other in radial directions relative to the outer cylinder 251. The outer cylinder 251 accommodates the pivot mechanism 25*a* to be slidable in axial directions of the outer cylinder 251. The pair of lock pins 252 is biased radially outward by the spring 253. A lost motion spring 254 for biasing the pivot mechanism 25*a* by pushing it upward from the outer cylinder 251 is provided between an inner bottom part of the outer cylinder 251 and a bottom part of the pivot mechanism 25*a*.

When the lock pins 252 are fitted into the penetrating holes 251*a* of the outer cylinder 251, the pivot mechanism 25*a* located above the lock pins 252 is fixed in a state of projecting upward. In this state, the top portion of the pivot mechanism 25*a* serves as the supporting point for each of the swing arms 20 and 21 to swing, and therefore, when the rotations of the camshafts 18 and 19 cause the cam parts 18*a* and 19*a* to push the cam followers 20*a* and 21*a* downward, the intake and exhaust valves 14 and 15 are pushed downward to open, against the biasing forces of the return springs 16 and 17. Therefore, by bringing the valve stopping mechanisms 25*b* of the first and fourth cylinders into the state where the lock pins 252 are fitted into the penetrating holes 251*a*, the all-cylinder operation can be performed.

On the other hand, as illustrated in FIGS. 2B and 2C, when outer end surfaces of both of the lock pins 252 are pushed by the operating oil pressure, both of the lock pins 252 retreat inward in radial directions relative to the outer cylinder 251 so as to come close to each other against the pushing force of the lock spring 253, and the lock pins 252 do not fit into the penetrating holes 251*a* of the outer cylinder 251. Thus, the pivot mechanism 25*a* located above the lock pins 252 moves downward in the outer cylinder 251 in an axial direction along with the lock pins 252. Thus, the pivot mechanism 25*a* is in a valve stopping state.

Specifically, since the return springs 16 and 17 for biasing the intake and exhaust valves 14 and 15 upward have stronger biasing forces than the lost motion spring 254 for biasing the pivot mechanism 25*a* upward, when the rotations of the camshafts 18 and 19 cause the cam parts 18*a* and 19*a* to push the cam followers 20*a* and 21*a* downward, top parts of the intake and exhaust valves 14 and 15 serve as the supporting points for the swing arms 20 and 21 to swing, and the pivot mechanisms 25*a* are pushed downward against the biasing forces of the lost motion springs 254 while the intake and exhaust valves 14 and 15 are closed. Therefore, by bringing the valve stopping mechanisms 25*b* into the state where they are unfitted into the penetrating holes 251*a* by the operating oil pressure, the reduced-cylinder operation can be performed.

The camshaft 18 is provided with an intake variable valve timing mechanism 32 (hereinafter, referred to as the VVT 32) for changing a phase angle of the camshaft 18 with respect to the crankshaft 9 (see FIG. 6). The VVT 32 is an electric variable valve timing mechanism driven by a motor. The detailed description of the configuration of the electric variable valve timing mechanism itself is omitted since it is well known.

Figure 3:
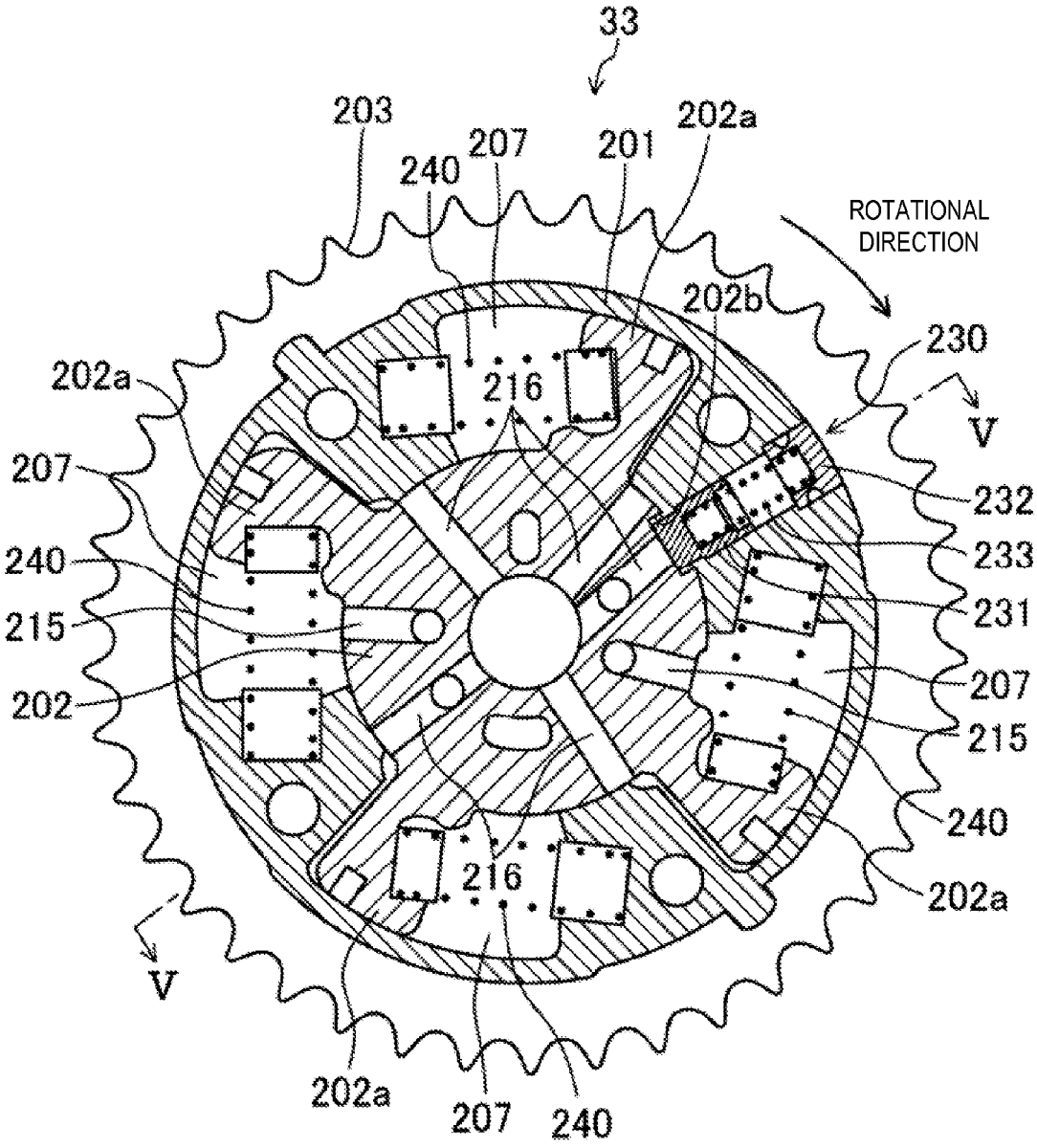
FIG. 3 is a cross-sectional view illustrating a state of the exhaust variable valve timing mechanism when a vane body (camshaft) is locked by a lock pin of a locking mechanism, taken along a plane perpendicular to the camshaft.
Figure 4:
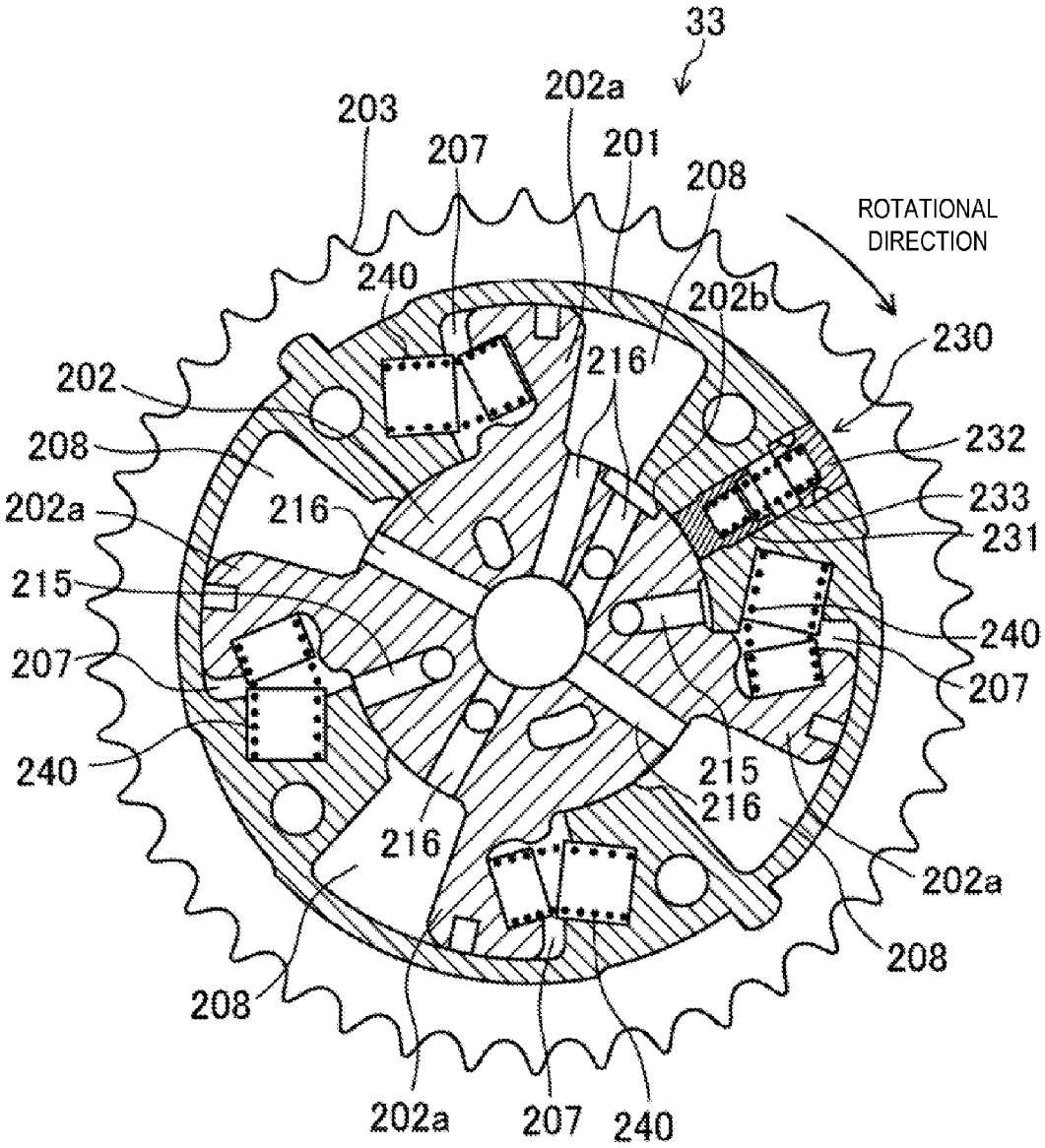
FIG. 4 is a view corresponding to FIG. 3, illustrating a state where the lock pin of the locking mechanism is unlocked and the vane body is turned to a retarding side inside a housing.
Figure 5:
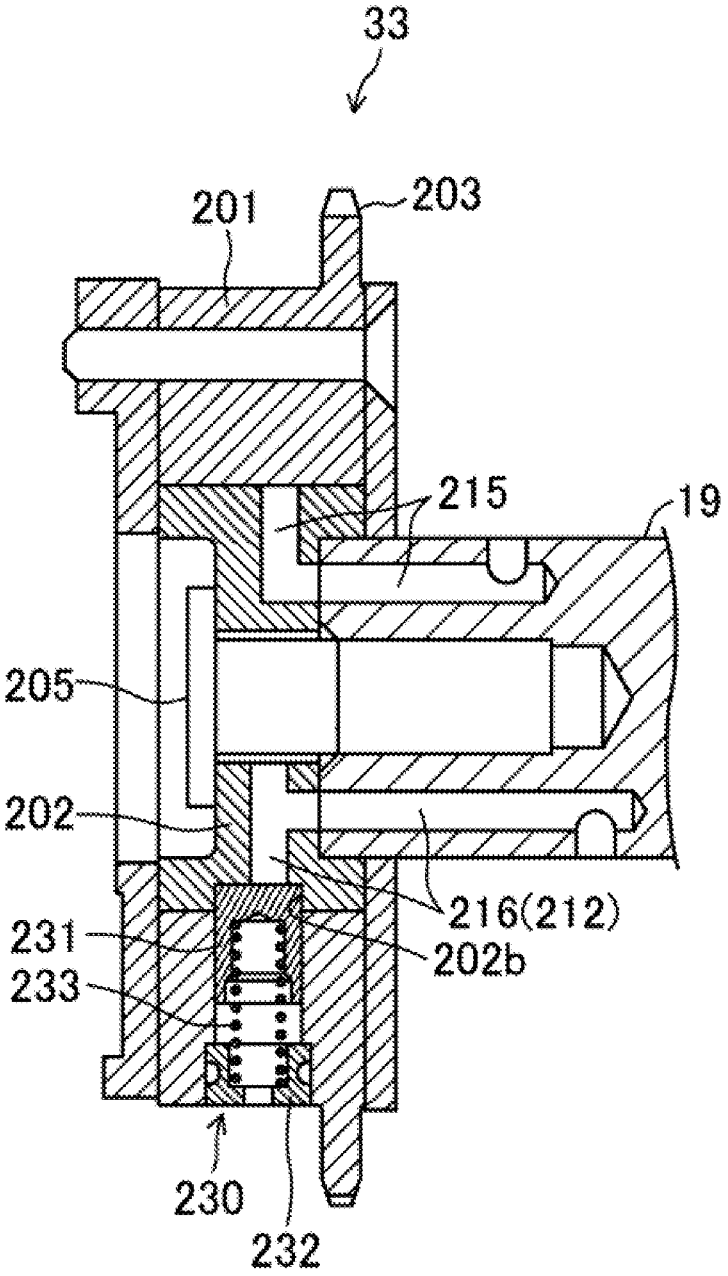
FIG. 5 is a cross-sectional view of FIG. 3, taken along a line V-V.

Next, an exhaust variable valve timing mechanism 33 (hereinafter, referred to as the VVT 33), which is one of the hydraulically-operated devices, is described with reference to FIGS. 3 to 5.

The VVT 33 has a substantially-annular housing 201 and a vane body 202 accommodated inside the housing 201. The housing 201 is coupled integrally and rotatably to a cam pulley 203 for rotating in synchronization with the crankshaft 9, and rotates in conjunction with the crankshaft 9. The vane body 202 is integrally and rotatably coupled by a bolt 205 (see FIG. 5) to the camshaft 19 for opening and closing the exhaust valves 15.

A plurality of advance-side operation chambers 207 and a plurality of retard-side operation chambers 208 are formed inside the housing 201. Each of the advance-side operation chambers 207 is partitioned from the corresponding retard-side operation chamber 208 by vanes 202*a* provided in an outer circumferential face of the vane body 202 and extending to an inner circumferential face of the housing 201. The advance-side operation chambers 207 and the retard-side operation chambers 208 are connected to an exhaust first direction switch valve 35 as a hydraulic-pressure control valve, via an advance-side oil path 211 and a retard-side oil path 212, respectively (see FIG. 6). Each of the camshaft 19 and the vane body 202 is formed with advance-side passages 215 and retard-side passages 216. The advance-side passages 215 form a part of the advance-side oil path 211 and the retard-side passages 216 form a part of the retard-side oil path 212.

The advance-side passages 215 extend radially from a position near the center of the vane body 202 so as to connect with the advance-side operation chambers 207, and the retard-side passages 216 extend radially from a position near the center of the vane body 202 so as to connect with the retard-side operation chambers 208. One of the plurality of retard-side passages 216 is formed in a part of the outer circumferential face of the vane body 202 where the vanes 202*a* are not formed, and communicates with a bottom of a recessed fitting portion 202*b* into which a later-described lock pin 231 (locking member) fits. This retard-side passage 216 communicates with one of the plurality of retard-side operation chambers 208 via the recessed fitting portion 202*b*.

The VVT 33 is provided with a locking mechanism 230 for locking the operation of the VVT 33. The locking mechanism 230 has a lock pin 231 for fixing a phase angle of the camshaft 19 with respect to the crankshaft 9 to a specific phase angle. In this embodiment, the specific phase angle is a most-advanced phase angle; however, it is not limited to this and may be any phase angle.

The lock pin 231 is disposed to be slidable in radial directions relative to the housing 201. A spring holder 232 is fixed to a part of the housing 201 radially outward from the lock pin 231, and a lock pin biasing spring 233 for biasing the lock pin 231 radially inward is disposed between the spring holder 232 and the lock pin 231. When the recessed fitting portion 202*b* is located at a position opposing the lock pin 231, the lock pin 231 is fitted into the recessed fitting portion 202*b* by the lock pin biasing spring 233 so as to be in a locked state. Thus, the vane body 202 is fixed to the housing 201, and the phase angle of the camshaft 19 with respect to the crankshaft 9 is fixed.

The advance-side operation chambers 207 and the retard-side operation chambers 208 are connected to the exhaust first direction switch valve 35 via the advance-side oil path 211 and the retard-side oil path 212, and the exhaust first direction switch valve 35 is connected to a later-described variable displacement oil pump 36 as a variable oil pump for supplying the oils (see FIG. 6). By controlling the exhaust first direction switch valve 35, an oil supply amount for the advance-side operation chambers 207 and the retard-side operation chambers 208 of the VVT 33 can be adjusted. When the oil is supplied by a larger supply amount (at a higher oil pressure) to the advance-side operation chambers 207 than to the retard-side operation chambers 208 through the control of the exhaust first direction switch valve 35, the camshaft 19 turns in its rotational direction (the arrow direction in FIGS. 3 and 4), and an open timing of each exhaust valve 15 is advanced, and the lock pin 231 fits into the recessed fitting portion 202*b* at a most-advanced position of the camshaft 19 (see FIG. 3). On the other hand, when the oil is supplied by a larger supply amount (at higher oil pressure) to the retard-side operation chambers 208 than to the advance-side operation chambers 207 through the control of the exhaust first direction switch valve 35, the camshaft 19 turns in a direction opposite to the rotational direction, and the open timing of each exhaust valve 15 is retarded (see FIG. 4). In a case of retarding from the most-advanced position of the camshaft 19, the lock pin 231 is pushed radially outward by the oil pressure, against the force of the lock pin biasing spring 233, so as to unlock. Here, the retard-side operation chambers 208, except for the retard-side operation chamber 208 which communicates with the recessed fitting portion 202*b*, are already filled with the oil, and the open timing of each exhaust valve 15 can be retarded through the control of the exhaust first direction switch valve 35 to turn the camshaft 19 in the opposite direction to the rotational direction immediately after the unlocking. Note that, to unlock the lock pin 231 of the VVT 33, an oil pressure that would overcome the biasing force of the lock pin biasing spring 233 needs to be supplied to the retard-side operation chambers 208, and the oil pressure can be obtained by the control of the exhaust first direction switch valve 35. Moreover, by supplying the oil pressure overcoming the biasing force to the retard-side operation chambers 208 while supplying an oil pressure (basically, the oil pressure close to zero) lower than the oil pressure overcoming the biasing force to the advance-side operation chambers 207, the camshaft 19 turns in the opposite direction to the rotational direction immediately after the unlocking by the lock pin 231, and the camshaft 19 shifts out from the locked position. Then, a control of an open phase of each exhaust valve 15 is performed through the control of the exhaust first direction switch valve 35.

A compression coil spring 240 is disposed between each vane 202*a* of the VVT 33 and a part of the housing 201 opposing the vane 202*a* from the side opposite to the rotational direction of the camshaft 19 (i.e., in each advance-side operation chamber 207). The compression coil spring 240 biases the vane body 202 to the advance side to assist the shifting of the vane body 202 to the advance side. Since the camshaft 19 receives a load from a later-described fuel pump 81 and a later-described vacuum pump 82 (see FIG. 6), the vane body 202 is assisted to overcome the load and surely move to shift to its most-advanced position (to surely fit the lock pin 231 into the recessed fitting portion 202*b*).

When an open phase of each intake valve 14 is changed to advance (and/or the open phase of each exhaust valve 15 is changed to retard) by the VVT 32 (and/or the VVT 33), the open period of the exhaust valve 15 overlaps with the open period of the intake valve 14. By particularly changing the open phase of the intake valve 14 to advance so as to overlap the open period of the intake valve 14 with the open period of the exhaust valve 15, an internal EGR amount during engine combustion can be increased, and a pumping loss can be reduced to improve fuel consumption performance. Moreover, a combustion temperature can be suppressed, and thus, the generation of NOx can be reduced, which improves exhaust gas purification. On the other hand, when the open phase of each intake valve 14 is changed to retard (and/or the open phase of each exhaust valve 15 is changed to advance) by the VVT 32 (and/or the VVT 33), the valve overlapping amount between the open period of the intake valve 14 and the open period of the exhaust valve 15 is reduced. Therefore, in a low engine load state where the engine load is lower than a predetermined value (e.g., in idling), stable combustibility can be secured. In this embodiment, to increase the valve overlapping amount as much as possible in a high engine load state, the open periods of the intake and exhaust valves 14 and 15 are also overlapped in the low engine load state.

Next, an oil supply device 1 for supplying the oil to the engine 2 described above is described in detail with reference to FIG. 6. As illustrated in FIG. 6, the oil supply device 1 includes a variable displacement oil pump 36 (hereinafter, referred to as the oil pump 36) driven by the rotation of the crankshaft 9, and an oil supply path 50 (hydraulic-pressure path) connected to the oil pump 36 and for introducing the oil pumped by the oil pump 36 to respective parts of the engine 2 to be lubricated and the hydraulically-operated devices. The oil pump 36 is an auxiliary component driven by the engine 2.

The oil supply path 50 is formed of pipes and passages bored in the cylinder head 4, the cylinder block 5 and the like. The oil supply path 50 communicates with the oil pump 36 and includes a first communicating passage 51 extending from the oil pump 36 (specifically, a discharge port 361*b* described later) to a branching position 54*a* inside the cylinder block 5. The oil supply path 50 also includes the main gallery 54 extending inside the cylinder block 5 in the cylinder-row direction. The oil supply path 50 also includes a second communicating passage 52 extending from the branching position 54*b* on the main gallery 54 to the cylinder head 4. The oil supply path 50 also includes a third communicating passage 53 extending between the intake and exhaust sides inside the cylinder head 4 in a substantially horizontal direction. The oil supply path 50 also includes a plurality of oil paths 61 to 68 branching from the third communicating passage 53 within the cylinder head 4.

The oil pump 36 is a known variable displacement oil pump for varying its oil discharge amount by changing its capacity. The oil pump 36 includes a housing 361 formed of a pump body and a cover member. The pump body has a pump accommodating chamber having a space therein that is formed to open on one end side and has a circular shape in a cross-section. The cover member blocks the end-side opening of the pump body. The oil pump 36 also includes a driveshaft 362 rotatably supported by the housing 361, penetrating through a substantially-central area of the pump accommodating chamber, and rotatably driven by the crankshaft 9. The oil pump 36 also includes a pump element. The pump element has a rotor 363 rotatably accommodated inside the pump accommodating chamber and coupled to the driveshaft 362 in its central portion, and vanes 364 accommodated to be projectable in respective slits which are radially formed by notching an outer circumferential part of the rotor 363. The oil pump 36 also includes a cam ring 366 disposed on the outer circumferential side of the pump element to be able to be eccentric with respect to the rotational center of the rotor 363 and forming pump chambers 365 which are a plurality of operating oil chambers in cooperation with the rotor 363 and the adjacent vanes 364. The oil pump 36 also includes a spring 367 that is a biasing member accommodated inside the pump body and for always biasing the cam ring 366 to a side that an eccentric amount of the cam ring 366 with respect to the rotational center of the rotor 363 increases. The oil pump 36 also includes a pair of ring members 368 disposed to be slidable on both inner circumferential side portions of the rotor 363 and having smaller diameters than the rotor 363. The housing 361 includes a suction port 361*a* from which the oil is supplied into the pump chambers 365 located inside the housing 361, and a discharge port 361*b* where the oil is discharged from the pump chambers 365. Inside the housing 361, a pressure chamber 369 is formed by an inner circumferential face of the housing 361 and an outer circumferential face of the cam ring 366, and an introduction hole 369*a* opening to the pressure chamber 369 is formed. The oil is introduced into the pressure chamber 369 from the introduction hole 369*a* to swing the cam ring 366 centering on a supporting point 361*c* and cause the rotor 363 to be relatively eccentric with respect to the cam ring 366, so that the discharge capacity of the oil pump 36 is changed.

The suction port 361*a* of the oil pump 36 is connected with an oil strainer 39 oriented into the oil pan 6. On the first communicating passage 51 communicating to the discharge port 361*b* of the oil pump 36, an oil filter 37 and an oil cooler 38 are disposed in this order from the upstream side to the downstream side, and the oil accumulated within the oil pan 6 is sucked by the oil pump 36 through the oil strainer 39, filtered by the oil filter 37, cooled by the oil cooler 38, and then introduced into the main gallery 54 inside the cylinder block 5.

The main gallery 54 is connected with the oil jets 28 for injecting the cooling oil toward the back surfaces of the four pistons 8, oil supplying parts 41 of metal bearings disposed in five main journals rotatably supporting the crankshaft 9, and oil supplying parts 42 of metal bearings rotatably coupling the four connecting rods to each other and disposed in crankpins of the crankshaft 9. The oil is always supplied to the main gallery 54.

A branching position 54*c* on the main gallery 54 is connected, in its downstream side, with an oil supplying part 43 for supplying the oil to a hydraulic chain tensioner and an oil path 40 for supplying the oil from the introduction hole 369*a* to the pressure chamber 369 of the oil pump 36 via a linear solenoid valve 49.

The oil path 67 branching from a branching position 53*a* of the third communicating passage 53 is connected with the exhaust first direction switch valve 35. Through the control of the exhaust first direction switch valve 35, the oil is supplied to the advance-side operation chambers 207 and the retard-side operation chambers 208 of the exhaust VVT 33 via the advance-side oil path 211 and the retard-side oil path 212, respectively. Moreover, the oil path 64 branching from the branching position 53*a* is connected with oil supplying parts 45 (see the white triangles Δ in FIG. 6) of metal bearings disposed to cam journals of the exhaust camshaft 19, the HLAs 24 (see the black triangles ▲ in FIG. 6), the HLAs 25 (see the white ellipses in FIG. 6), the fuel pump 81 driven by the camshaft 19 and for supplying the fuel at high pressure to the fuel injection valves which supply the fuel to the respective combustion chambers 11, and a vacuum pump 82 driven by the camshaft 19 and for securing a pressure of a brake master cylinder. The oil is always supplied to the oil path 64. Further, the oil path 66 branching from a branching position 64*a* of the oil path 64 is connected with the oil showers 30 for supplying the lubricating oil to the exhaust swing arms 21, and the oil is always supplied to the oil path 66.

Figure 6:
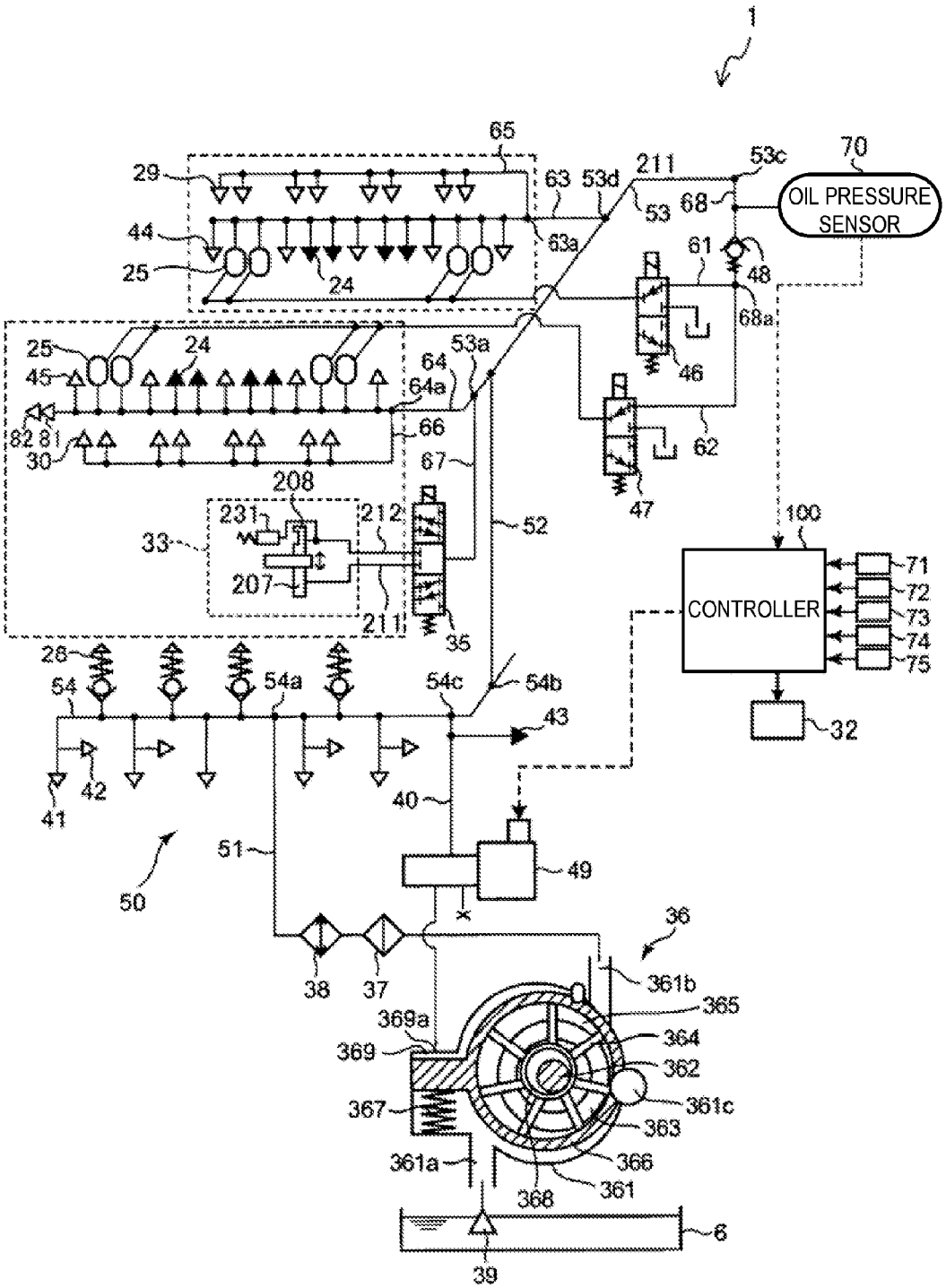
FIG. 6 is a view illustrating a schematic configuration of an oil supply device.

Also on the intake side, similarly to the exhaust side, the oil path 63 branching from a branching position 53*d* of the third communicating passage 53 is connected with oil supplying parts 44 (see the white triangles Δ in FIG. 6) of metal bearings disposed in cam journals of the intake camshaft 18, the HLAs 24 (see the black triangles ▲ in FIG. 6), and the HLAs 25 (see the white ellipses in FIG. 6). Further, the oil path 65 branching from a branching position 63*a* of the oil path 63 is connected with the oil showers 29 for supplying the lubricating oil to the intake swing arms 20.

Moreover, the oil path 68 branching from the branching position 53*c* of the third communicating passage 53 is provided therein with, in the following order from the upstream side to the downstream side, an oil pressure sensor 70 for detecting the oil pressure within the oil path 68 and a one-way valve 48 for regulating the oil flow to only one direction from upstream to downstream. The oil path 68 branches into the two oil paths 61 and 62 communicating with the attaching holes 26 and 27 for the HLAs 25 at a branching position 68*a* located downstream from the one-way valve 48. The oil paths 61 and 62 are connected with the valve stopping mechanisms 25*b* of the HLAs 25 on the intake and exhaust sides via the intake second direction switch valve 46 and exhaust second direction switch valve 47, and the oil paths 61 and 62 supply the oil to the valve stopping mechanisms 25*b* by controlling the intake and exhaust second direction switch valves 46 and 47, respectively.

After the lubricating oil and the cooling oil supplied to the metal bearings, which rotatably support the crankshaft 9 and the camshafts 18 and 19, the pistons 8, the camshafts 18 and 19 and the like, finish cooling and lubricating, they pass through a drain oil path (not illustrated) to drop onto the oil pan 6, and then are re-circulated by the oil pump 36.

The operation of the engine 2 is controlled by a controller 100. The controller 100 receives detection information from various sensors for detecting the operating state of the engine 2. For example, the controller 100 controls a crank angle sensor 71 to detect a rotational angle of the crankshaft 9, and acquires an engine speed based on the detection signal. Moreover, the controller 100 controls a throttle position sensor 72 to detect a stepped amount (accelerator opening) of an acceleration pedal caused by a driver of the vehicle in which the engine 2 is installed, and acquires the engine load based on the stepped amount. Further, the controller 100 controls the oil pressure sensor 70 to detect the pressure within the oil path 68. Moreover, the controller 100 controls an oil temperature sensor 73 disposed at substantially the same position as the oil pressure sensor 70, to detect a temperature of the oil within the oil path 68. The oil temperature sensor 73 may be disposed anywhere within the oil supply path 50. Further, the controller 100 controls cam angle sensors 74 respectively provided near the camshafts 18 and 19, to detect the rotational phases of the camshafts 18 and 19, and acquires phase angles of the VVTs 32 and 33 based on the cam angles. Moreover, the controller 100 controls a coolant temperature sensor 75 to detect a temperature of a coolant (hereinafter, referred to as the coolant temperature) for cooling the engine 2.

The controller 100 is a control device based on a well-known microcomputer, and includes a signal receiver for receiving the detection signals from the various sensors (e.g., the oil pressure sensor 70, the crank angle sensor 71, the throttle position sensor 72, the oil temperature sensor 73, the cam angle sensors 74, and the fluid temperature sensor 75), an operator for performing operation processing relating to the various controls, a signal output unit for outputting control signals to the devices to be controlled (e.g., the VVT 32, the exhaust first direction switch valve 35, the intake and exhaust second direction switch valves 46 and 47, and the linear solenoid valve 49), and a storage for storing programs and data required in the controls (e.g., later-described oil pressure control maps and duty ratio maps).

The linear solenoid valve 49 is a flow rate (discharge amount) control valve for controlling the discharge amount of the oil pump 36 according to the operating state of the engine 2. In this embodiment, the oil is supplied to the pressure chamber 369 of the oil pump 36 when the linear solenoid valve 49 is opened. The description of the configuration of the linear solenoid valve 49 itself is omitted since it is well known. Note that, the flow rate (discharge amount) control valve is not limited to the linear solenoid valve 49 and, for example, an electromagnetic control valve may be used.

Figure 7:
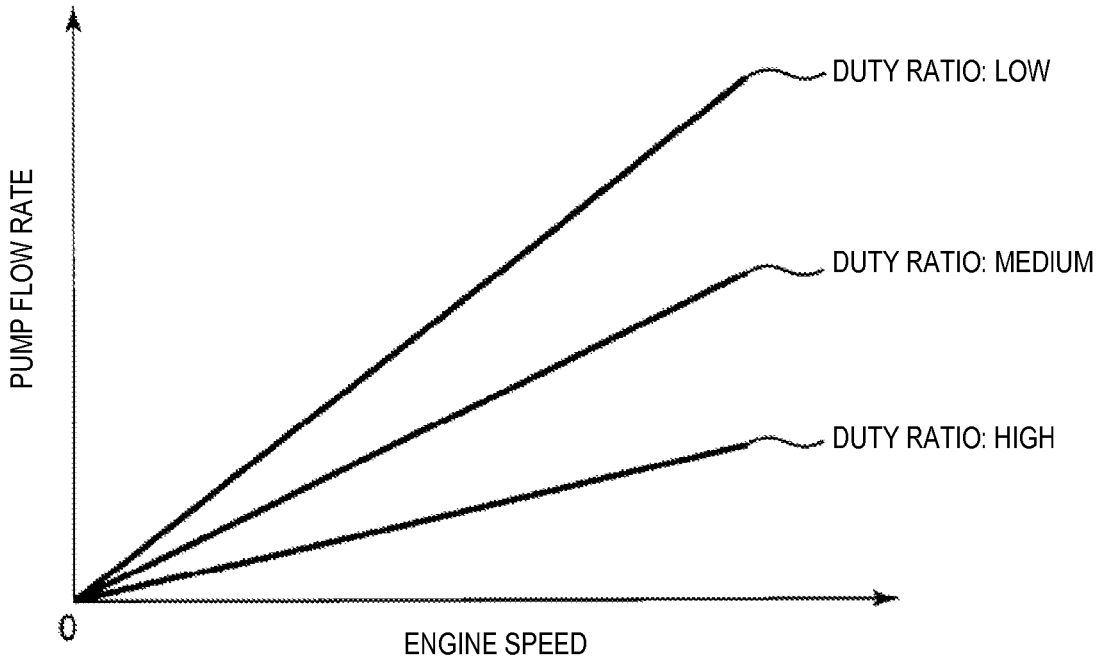
FIG. 7 is a chart illustrating a property of a variable displacement oil pump.

The controller 100 transmits, to the linear solenoid valve 49, a control signal of a duty ratio according to the operating state of the engine 2 so as to control, via the linear solenoid valve 49, the oil pressure to be supplied to the pressure chamber 369 of the oil pump 36. By using the oil pressure inside the pressure chamber 369 to control the eccentric amount of the cam ring 366 and control change amounts of the internal volumes of the pump chambers 365, the flow rate (discharge amount) of the oil pump 36 is controlled. In other words, the capacity of the oil pump 36 is controlled by the duty ratio. Here, since the oil pump 36 is driven by the crankshaft 9 of the engine 2, as illustrated in FIG. 7, the flow rate (discharge amount) of the oil pump 36 is in proportion to the engine speed (pumping speed). Further, in a case where the duty ratio indicates a rate of a power distribution period of time of the linear solenoid valve 49 with respect to a period of time for one cycle of the engine, as illustrated in FIG. 7, as the duty ratio becomes higher, the oil pressure to the pressure chamber 369 of the oil pump 36 becomes higher. Thus, the change of the flow rate of the oil pump 36 with respect to the engine speed becomes less.

Figure 8A:
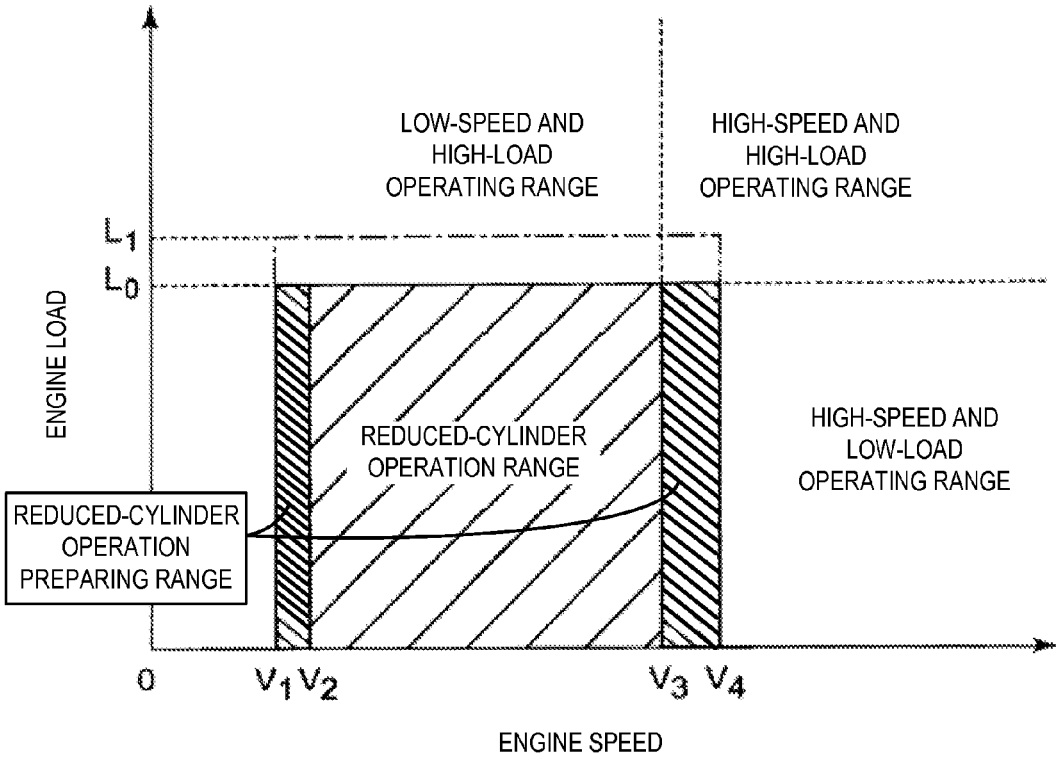
FIGS. 8A and 8B are views illustrating a reduced-cylinder operation range of the engine.
Figure 8B:
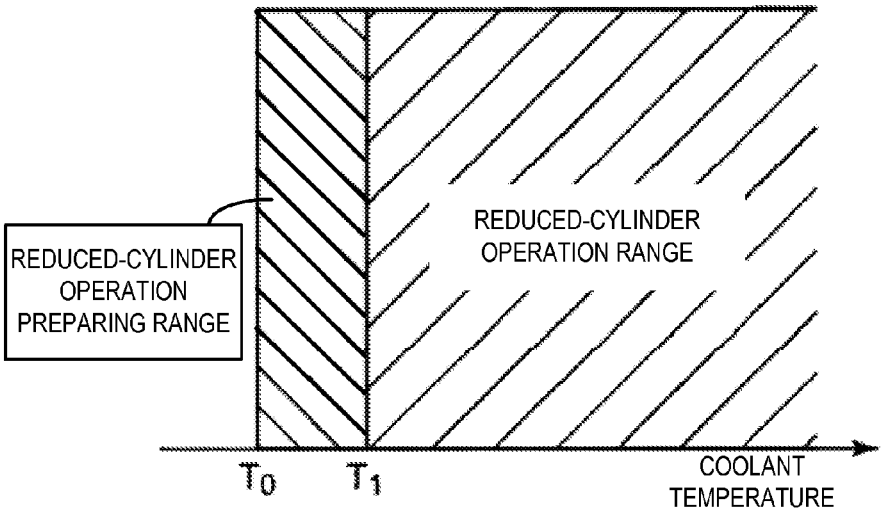

Next, the reduced-cylinder operation of the engine 2 is described with reference to FIGS. 8A and 8B. The reduced-cylinder operation and the all-cylinder operation of the engine 2 are switched therebetween according to the operating state of the engine 2. Specifically, the reduced-cylinder operation is performed when the operating state of the engine 2, which is grasped based on the engine speed, the engine load, and the coolant temperature of the engine 2, is within a reduced-cylinder operation range in FIGS. 8A and 8B. Moreover, as illustrated in FIGS. 8A and 8B, a reduced-cylinder operation preparing range is provided continuously next to the reduced-cylinder operation range, and when the operating state of the engine is within the reduced-cylinder operation preparing range, as a preparation for performing the reduced-cylinder operation, the oil pressure is increased to a required oil pressure of the valve stopping mechanism 25*b* in advance. Further, when the operating state of the engine 2 is outside the reduced-cylinder operation range and the reduced-cylinder operation preparing range, the all-cylinder operation is performed.

With reference to FIG. 8A, in a case where the engine is accelerated within a predetermined engine load range (L0 or lower) and the engine speed is increased, when the engine speed is lower than a predetermined speed V1, the all-cylinder operation is performed, when the engine speed becomes V1 or higher but lower than V2 (>V1), the preparation for the reduced-cylinder operation is performed, and when the engine speed becomes V2 or higher, the reduced-cylinder operation is performed. Moreover, for example, in a case where the engine is decelerated at the predetermined engine load (L0 or lower) and the engine speed is reduced, when the engine speed is V4 or higher, the all-cylinder operation is performed; when the engine speed becomes V3 (<V4) or higher but lower than V4, the preparation for the reduced-cylinder operation is performed; and when the engine speed becomes lower than V3, the reduced-cylinder operation is performed.

With reference to FIG. 8B, in a case where the engine 2 is warmed up and the coolant temperature is increased while the vehicle travels within a predetermined engine speed range (between V2 and V3) and the predetermined engine load range (L0 or lower), the all-cylinder operation is performed when the coolant temperature is lower than T0, the preparation of the reduced-cylinder operation is performed when the coolant temperature becomes T0 or higher but lower than T1, and the reduced-cylinder operation is performed when the coolant temperature becomes T1 or higher.

If the reduced-cylinder operation preparing range is not provided, when switching from the all-cylinder operation to the reduced-cylinder operation, the oil pressure is increased to the required oil pressure of the valve stopping mechanism 25*b* after the operating state of the engine 2 enters the reduced-cylinder operation range. In this case, a period of time in which the reduced-cylinder operation is performed becomes shorter by a period of time required for the oil pressure to reach the required oil pressure, and thus, the fuel consumption efficiency of the engine 2 accordingly degrades.

Therefore, in this embodiment, in order to improve the fuel consumption efficiency of the engine 2 as much as possible, the reduced-cylinder operation preparing range is provided continuously next to the reduced-cylinder operation range, so that the oil pressure is increased beforehand in the reduced-cylinder operation preparing range. Moreover, a target oil pressure (see FIG. 9A) is set so as to eliminate the time loss for the oil pressure to reach the required oil pressure.

Note that, as illustrated in FIG. 8A, the range continuously next to the reduced-cylinder operation range on the higher engine load side, which is indicated by the dashed line, may be the reduced-cylinder operation preparing range. Thus, for example, in a case where the engine load is reduced within the predetermined engine speed range (between V2 and V3), the operation of the engine 2 may be designed such that when the engine load is L1 (>L0) or higher, the all-cylinder operation is performed; when the engine load becomes L0 or higher but lower than L1, the preparation for the reduced-cylinder operation is performed; and when the engine load becomes lower than L0, the reduced-cylinder operation is performed.

Next, required oil pressures of the respective hydraulically-operated devices (here, in addition to the valve stopping mechanism 25*b* and the VVT 33, the oil jets 28, the metal bearings, such as the journals of the crankshaft 9, are also included) and the target oil pressure of the oil pump 36 are described with reference to FIGS. 9A and 9B. The oil supply device 1 of this embodiment supplies the oil to the plurality of hydraulically-operated devices by the single oil pump 36, and the required oil pressures of the respective hydraulically-operated devices change according to the operating state of the engine 2. Therefore, to obtain the oil pressure required by all the hydraulically-operated devices in all the operating states of the engine 2, the oil pump 36 needs to set, for each operating state of the engine 2, an oil pressure higher than the highest required oil pressure among the required oil pressures of the respective hydraulically-operated devices to be the target oil pressure for the operating state of the engine 2. Therefore, in this embodiment, the target oil pressure is set to satisfy the required oil pressures of the valve stopping mechanisms 25*b*, the oil jets 28, the metal bearings (such as the journals of the crankshaft 9), and the VVT 33 of which the required oil pressures are comparatively high among all the hydraulically-operated devices, because by setting the target oil pressure as above, the required oil pressures of the other hydraulically-operated devices of which the required oil pressure is comparatively low are naturally satisfied.

Figure 9A:
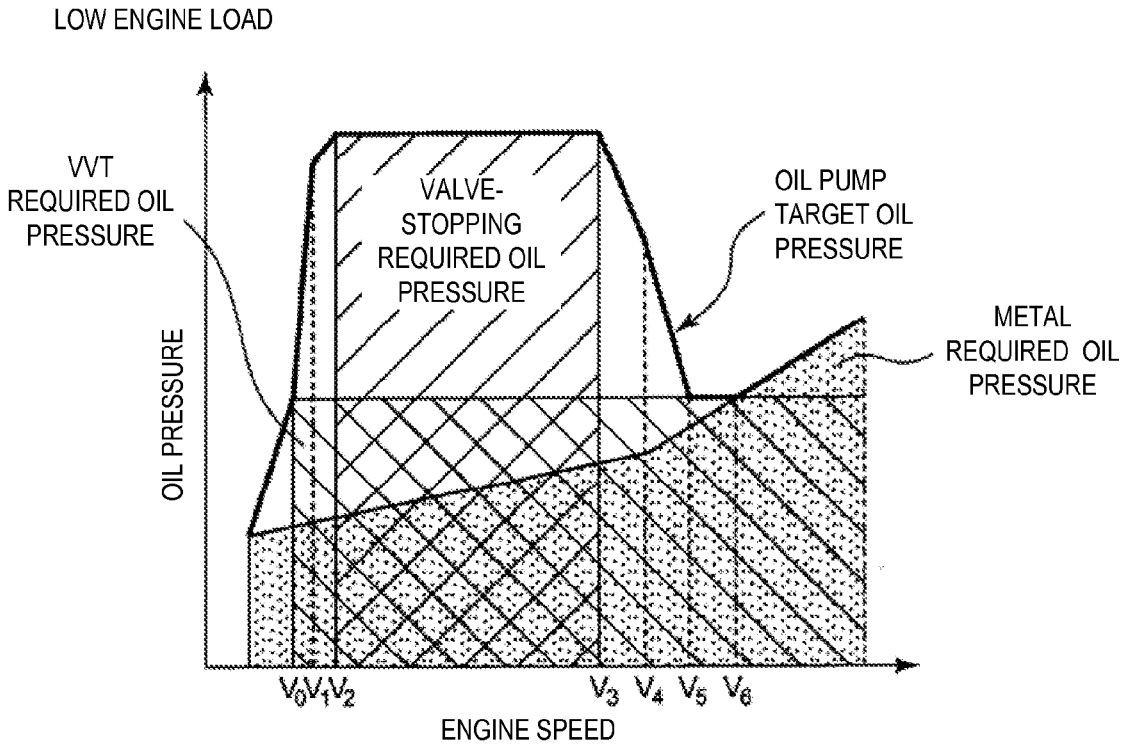
FIGS. 9A and 9B are charts for describing the setting of a target oil pressure of the pump.

With reference to FIG. 9A, when the engine 2 is operated in the low engine load state, the hydraulically-operated devices of which the required oil pressure is comparatively high are the VVT 33, the metal bearings, and the valve stopping mechanism 25*b*. The required oil pressures of these respective hydraulically-operated devices change according to the operating state of the engine 2. For example, each of the required oil pressure of the VVT 33 (described as the "VVT required oil pressure" in FIGS. 9A and 9B) is substantially fixed when the engine speed is V0 (<V1) or higher. The required oil pressure of the metal bearings (described as the "metal required oil pressure" in FIGS. 9A and 9B) increases as the engine speed is increased. The required oil pressure of the valve stopping mechanisms 25*b* (described as the "valve-stopping required oil pressure" in FIGS. 9A and 9B) is substantially fixed when the engine speed is within the predetermined range (between V2 and V3). Further, in a case where these required oil pressures are compared with respect to the engine speed, when the engine speed is lower than V0, only the metal required oil pressure is required; when the engine speed is between V0 and V2, the VVT required oil pressure is the highest; when the engine speed is between V2 and V3, the required valve-stopping oil pressure is the highest; when the engine speed is between V3 and V6, the VVT required oil pressure is the highest; and when the engine speed is V6 or higher, the metal required oil pressure is the highest. Therefore, the target oil pressure of the oil pump 36 needs to be set by having the highest required oil pressure as a reference target oil pressure at each engine speed range.

Here, in the engine speed ranges (between V1 and V2, and between V3 and V4) adjacent to the engine speed range in which the reduced-cylinder operation is performed (between V2 and V3), the reference target oil pressure is corrected to be set so that the target oil pressure increases toward the valve-stopping required oil pressure beforehand to prepare for the reduced-cylinder operation. According to this, as described in FIGS. 8A and 8B, the time loss for the oil pressure to reach the valve-stopping required oil pressure when the engine speed becomes the speed at which the reduced-cylinder operation is performed can be eliminated to improve the fuel consumption efficiency of the engine. One example of the target oil pressure of the oil pump 36 set by this correction (described as the "oil pump target oil pressure" in FIGS. 9A and 9B) is indicated by the thick line in FIG. 9A (between V1 and V2, and between V3 and V4).

Further, considering a response delay of the oil pump 36, an overload of the oil pump 36 and the like, it is preferred that the corrected reference target oil pressure for the reduced-cylinder operation preparation described above is further corrected to be set as the target oil pressure by either being gradually increased or reduced based on the engine speed while maintaining the oil pressure higher than the required oil pressure, so that the change of the oil pressure at the engine speeds (e.g., V0, V1 and V4) at which the required oil pressure significantly changes with respect to the change of the engine speed becomes smaller. One example of the target oil pressure of the oil pump 36 set by this correction is indicated by the thick line in FIG. 9A (lower than V0, between V0 and V1, and between V4 and V5).

Figure 9B:
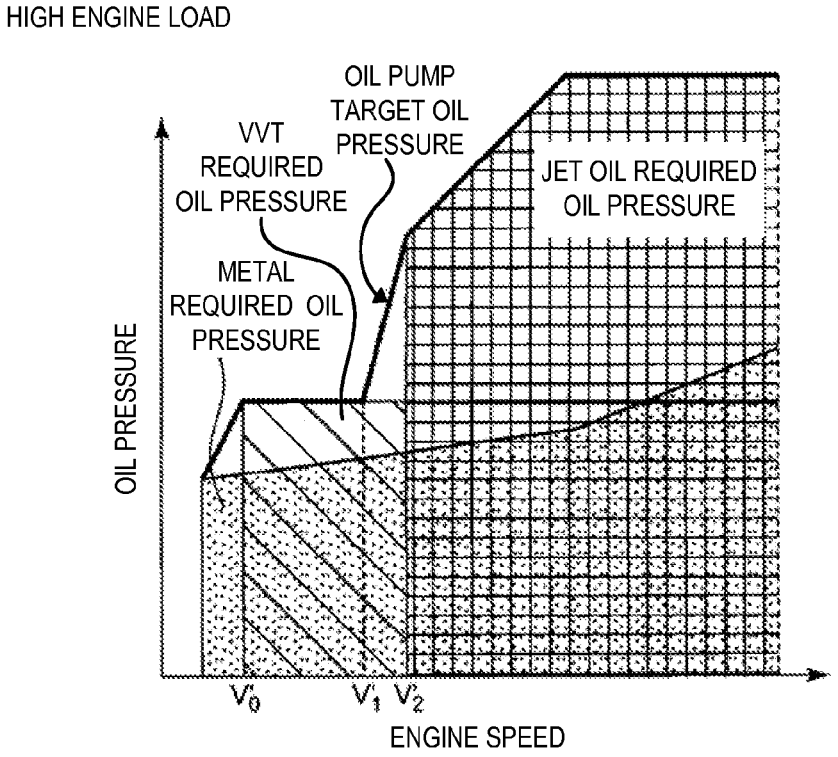

With reference to FIG. 9B, when the engine 2 is operated in the high engine load state, the hydraulically-operated devices of which the required oil pressure is comparatively high are the VVT 33, the metal bearings, and the oil jets 28. Similarly to the case of the operation in the low engine load state, the required oil pressures of these respective hydraulically-operated devices change according to the operating state of the engine 2. For example, if the VVT required oil pressure is substantially constant when the engine speed is V0' or higher, the metal required oil pressure becomes higher as the engine speed is increased. Moreover, if the required oil pressure of the oil jet 28 is zero when the engine speed is lower than VT, then the required oil pressure increases as the engine speed increases until it reaches a certain speed, and the required oil pressure is constant when the engine speed is higher than the certain speed.

In the case of the operation in the high engine load state, also similarly to the case of the operation in the low engine load state, it is preferred that the reference target oil pressure is corrected to be set as the target oil pressure at the engine speeds (e.g., V0' and VT) at which the required oil pressure significantly changes with respect to the change of the engine speed, and one example of the target oil pressure of the oil pump 36 which is set by being suitably corrected (particularly corrected at V0' or lower, or between V1' and V2') is indicated by the thick line in FIG. 9B.

Note that, although the illustrated target oil pressure of the oil pump 36 changes in a polygonal line, it may change smoothly in a curve. Moreover, in this embodiment, the target oil pressure is set based on the required oil pressures of the valve stopping mechanisms 25*b*, the oil jets 28, the metal bearings, and the VVT 33 of which the required oil pressure is comparatively high; however, the hydraulically-operated devices which are taken into consideration in setting the target oil pressure are not limited to these components. The target oil pressure may be set by taking a required oil pressure of any hydraulically-operated device into consideration, as long as its required oil pressure is comparatively high.

Next, oil pressure control maps are described with reference to FIGS. 10A, 10B and 10C. While the target oil pressure of the oil pump 36 in FIGS. 9A and 9B is set by using the engine speed as one parameter, in each of the oil pressure control maps in FIGS. 10A, 10B and 10C, the target oil pressure is indicated in a three-dimensional chart by also using the engine load and the oil temperature as parameters. Specifically, in each oil pressure control map, based on the highest required oil pressure among the required oil pressures of the respective hydraulically-operated devices for each operating state of the engine 2 (here, the oil temperature is also included in addition to the engine speed and the engine load), the target oil pressure according to the operating state is set beforehand.

Figure 10A:
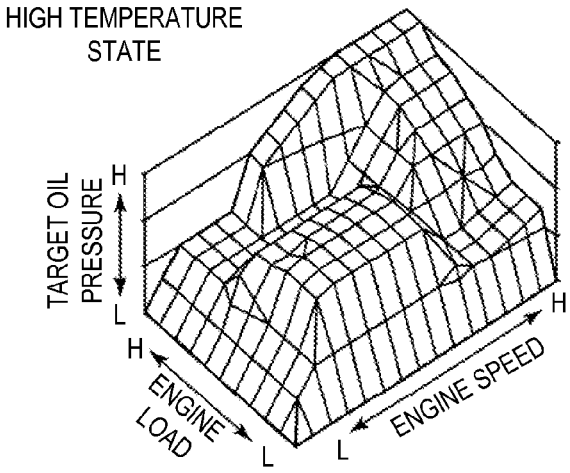
FIGS. 10A to 10C are oil pressure control maps each illustrating a target oil pressure according to an operating state of the engine.
Figure 10B:
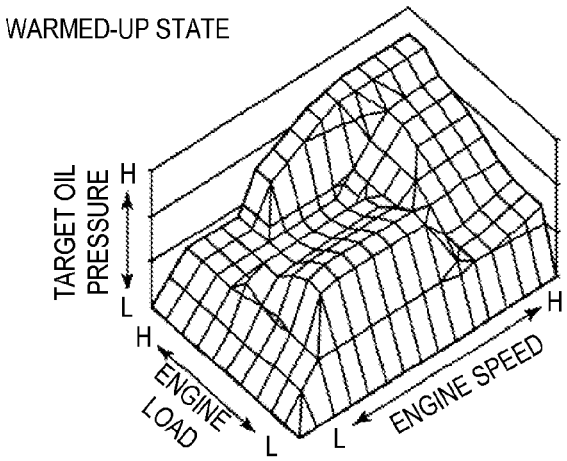
Figure 10C:
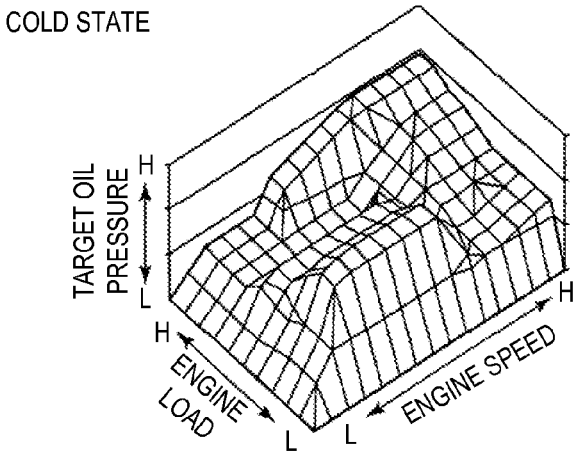

FIGS. 10A, 10B and 10C are the oil pressure control maps when the engine 2 (oil temperature) is in a high temperature state, in a warmed-up state, and in a cold state, respectively. The controller 100 changes the oil control map to use, according to the oil temperature. Specifically, when the engine 2 is started and while the engine 2 is in the cold state (the oil temperature is below T1), the controller 100 reads the target oil pressure corresponding to the operating state of the engine 2 (the engine speed and the engine load) based on the oil pressure control map for the cold state illustrated in FIG. 10C. When the engine 2 starts to be warmed up and the oil becomes the predetermined temperature T1 or higher, the controller 100 reads the target oil pressure based on the oil pressure control map for the warmed-up state illustrated in FIG. 10B. When the engine 2 is completely warmed up and the oil becomes a predetermined oil temperature T2 (>T1) or higher, the controller 100 reads the target oil pressure based on the oil pressure control map for the high temperature state illustrated in FIG. 10A.

Note that, in this embodiment, the target oil pressure is read by using the oil pressure control maps, each being set beforehand for each of the three oil temperature ranges (states) of the high temperature state, the warmed-up state, and the cold state; however, the target oil pressure may be read by only using one oil pressure control map without considering the oil temperature, or alternatively a larger number of oil pressure control maps may be prepared by dividing the temperature range more finely. Further, in this embodiment, the same target oil pressure P1 is taken for all the oil temperatures t within the temperature range ($T1 \leq t < T2$) targeted in one of the oil pressure control maps (e.g., the oil pressure control map for the warmed-up state); however, by taking a target oil pressure (P2) for one of the adjacent temperature ranges ($T2 \leq t$) into consideration, the target oil pressure p may be calculated according to the oil temperature t by using on a proportional conversion ($p=(t-T1)\times(P2-P1)/(T2-T1)$). Moreover, the target oil pressure may be the highest required oil pressure value calculated by comparing a metal required oil pressure which is stored in the storage of the controller 100 and set based on respective oil temperatures and engine speeds, with the required oil pressures required to operate the respective oil pressure operating devices. By enabling the highly accurate reading and calculation of the target oil pressure corresponding to the temperature, the pump capacity can be controlled at higher accuracy.

Next, duty ratio maps are described with reference to FIGS. 11A, 11B and 11C. Here, in each duty ratio map, the target oil pressure in one of the operating states of the engine 2 (the engine speed, the engine load, and the oil temperature) is read from the corresponding oil pressure control map described above. A target discharge amount of the oil supplied from the oil pump 36 is set based on the read target oil pressure while taking into consideration of, for example, flow resistances in the oil paths. A target duty ratio according to the operating state is set beforehand by being calculated based on the set target discharge amount while taking into consideration, for example, the engine speed (oil pump speed).

Figure 11A:
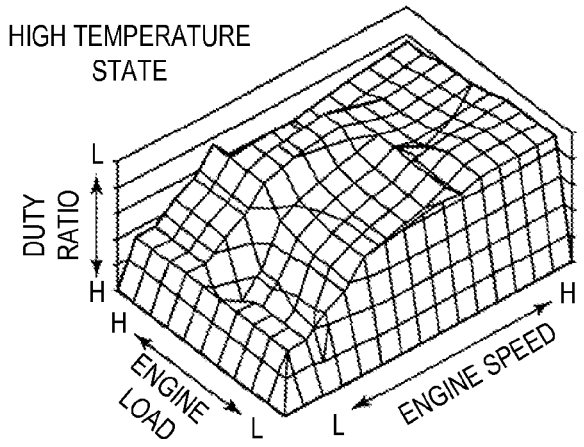
FIGS. 11A to 11C are duty ratio maps each illustrating a duty ratio according to the operating state of the engine.
Figure 11B:
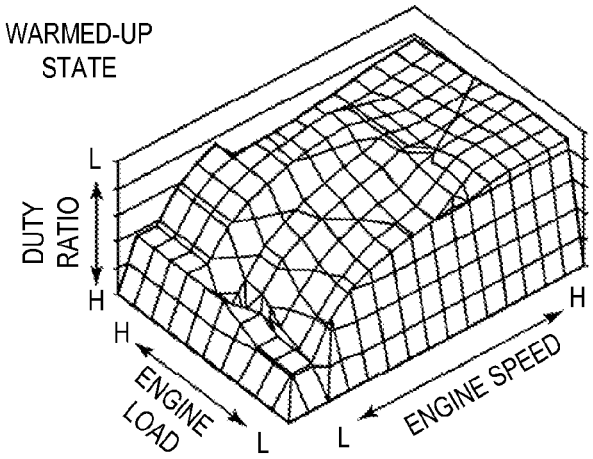
Figure 11C:
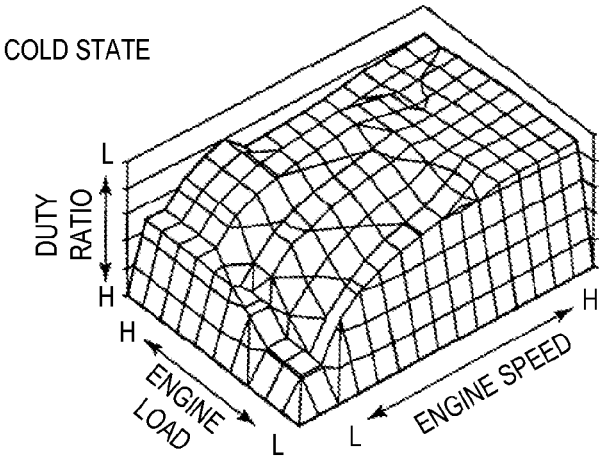

FIGS. 11A, 11B and 11C are the duty ratio maps when the engine 2 (oil temperature) is in the high temperature state, in the warmed-up state, and in the cold state, respectively. The controller 100 changes the duty ratio map to use, according to the oil temperature. Specifically, when the engine 2 is started, since the engine 2 is in the cold state, the controller 100 reads the duty ratio according to the operating state of the engine 2 (the engine speed and the engine load) based on the duty ratio map for the cold state illustrated in FIG. 11C. When the engine 2 is warmed up and the oil becomes the predetermined temperature T1 or higher, the controller 100 reads the target duty ratio based on the duty ratio map for the warmed-up state illustrated in FIG. 11B, and when the engine 2 is completely warmed up and the oil becomes the predetermined oil temperature T2 (>T1) or higher, the controller 100 reads the target duty ratio based on the duty ratio map for the high temperature state illustrated in FIG. 11A.

Note that, in this embodiment, the target duty ratio is read by using the duty ratio maps, each being set beforehand for each of the three oil temperature ranges (states) of the high temperature state, the warmed-up state, and the cold state; however, similarly to the oil pressure control maps described above, it may be such that only one duty ratio map is prepared or a larger number of duty ratio maps are prepared by dividing the temperature range more finely, or the target duty ratio may be calculated according to the oil temperature by using the proportional conversion.

Figure 12:
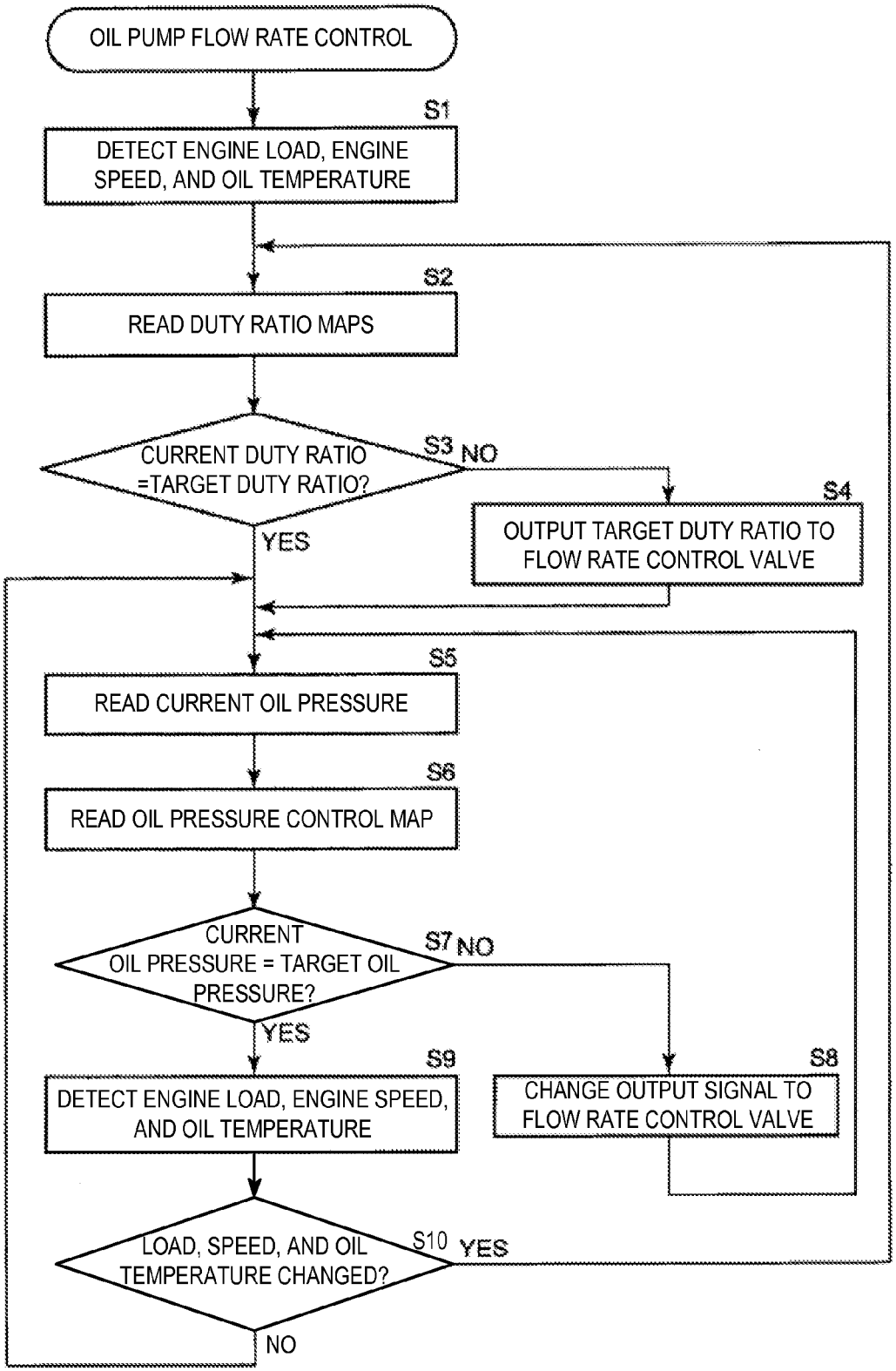
FIG. 12 is a flowchart illustrating an operation of a flow rate (discharge amount) control of the oil pump by a controller.

Next, the operation of a control of the flow rate (discharge amount) of the oil pump 36 performed by the controller 100 is described according to the flowchart in FIG. 12.

First, at S1, to grasp the operating state of the engine 2, the detection information is read from the various sensors to detect the engine load, the engine speed, the oil temperature, and the like.

Subsequently, at S2, the duty ratio maps stored in the controller 100 beforehand are read, and the target duty ratio is read according to the engine load, the engine speed and the oil temperature read at 51.

Following S2, at S3, whether the current duty ratio matches with the target duty ratio read at S2 is determined. If the determination result at S3 is positive, the control proceeds to S5. On the other hand, if the determination result at S3 is negative, the control proceeds to S4 where a signal indicating the target duty ratio is outputted to the linear solenoid valve 49 (described as "the flow rate control valve" in the flowchart of FIG. 12), and then the control proceeds to S5.

At S5, the current oil pressure is read by the oil pressure sensor 70, and next, at S6, the oil pressure control map stored beforehand is read and the target oil pressure according to the current operating state of the engine is read from the oil pressure control map.

Following S6, at S7, whether the current oil pressure matches with the target oil pressure read at S6 is determined. If the determination result at S7 is negative, the control proceeds to S8 where an output signal indicating the target duty ratio after being changed by a predetermined rate is outputted to the linear solenoid valve 49, and then the control returns back to S5. Specifically, the discharge amount of the oil pump 36 is controlled so that the oil pressure to be detected by the oil pressure sensor 70 becomes the target oil pressure.

On the other hand, if the determination result at S7 is positive, the control proceeds to S9 where the engine load, the engine speed, and the oil temperature are detected, and next at S10, whether the engine load, the engine speed, and the oil temperature are changed is determined.

If the determination result at S10 is positive, the control returns back to S2, whereas if the determination result at S10 is negative, the control returns back to S5. Note that, the flow rate control described above is continued until the engine 2 is stopped.

The flow rate control of the oil pump 36 described above is a combination of a feedforward control of the duty ratio and a feedback control of the oil pressure, and by the flow rate control, an improvement in responsiveness by the feedforward control and an improvement in accuracy by the feedback control are achieved.

Figure 13:
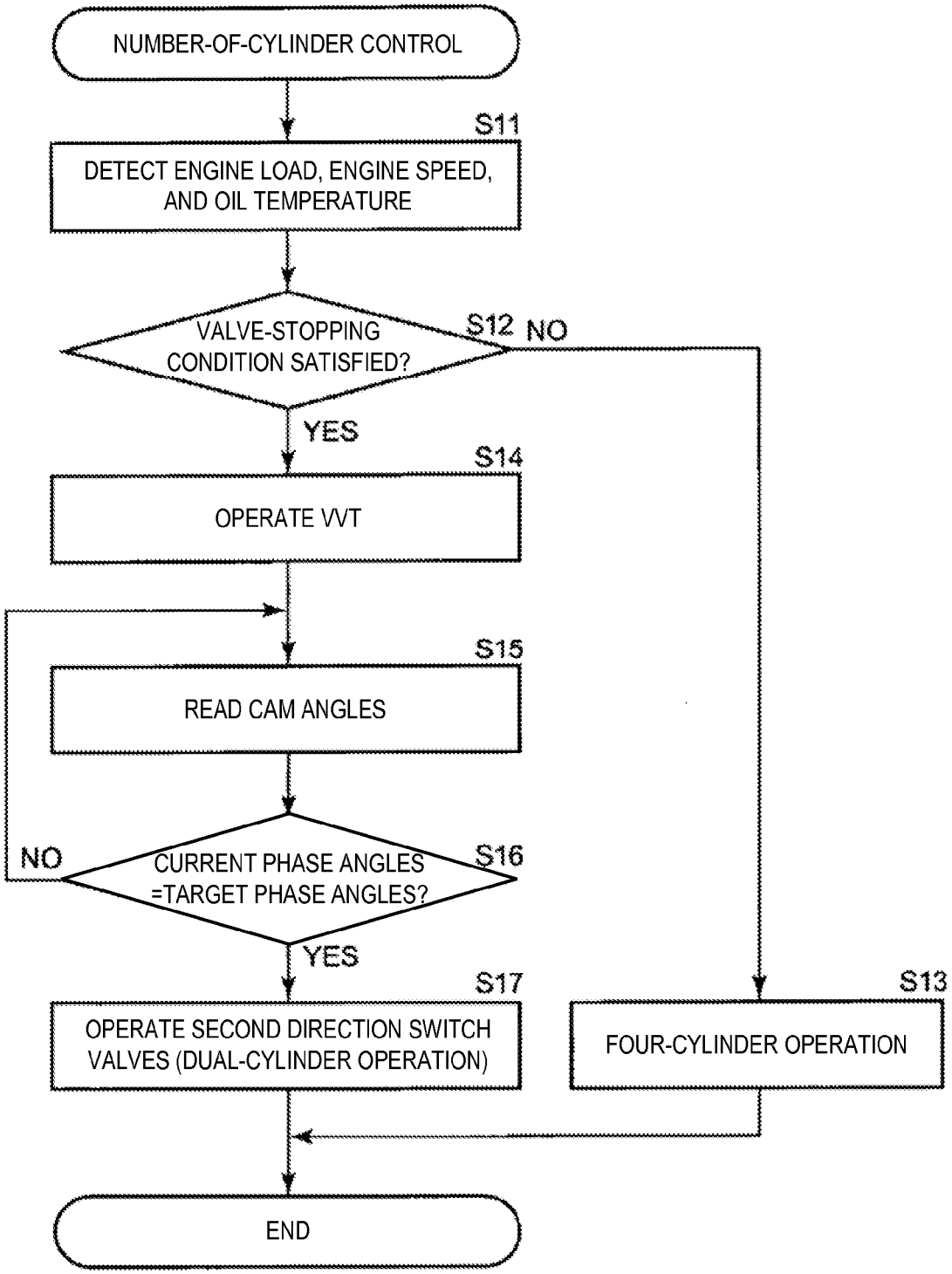
FIG. 13 is a flowchart illustrating an operation of a cylinder-number control of the engine by the controller.

Next, the operation of a number-of-cylinder control performed by the controller 100 is described according to the flowchart in FIG. 13.

First, at S11, to grasp the operating state of the engine 2, the detection information is read from the various sensors to detect the engine load, the engine speed, the coolant temperature, and the like.

Following S11, at S12, whether the current operating state of the engine 2 satisfies a valve-stopping condition (is within the reduced-cylinder operation range) is determined based on the engine load, the engine speed, and the coolant temperature which are read.

If the determination result at S12 is negative, the control proceeds to S13 where the four-cylinder operation (all-cylinder operation) is performed. Here, similar operations to those at S14 to S16 (described later) are performed for each cylinder to operate the VVT 32 and the exhaust first switch valve 35 so as to adjust the current phase angles of the VVTs 32 and 33, which correspond to current cam angles read from the cam angle sensors 74, to the target phase angles set according to the operating state of the engine 2.

On the other hand, if the determination result at S12 is positive, the control proceeds to S14 where the VVT 32 and the exhaust first direction switch valve 35 are operated, and next at S15, the current cam angles are read from the cam angle sensors 74.

Following S15, at S16, whether current phase angles of the VVTs 32 and 33 corresponding to the read current cam angles are the target phase angles is determined.

If the determination result at S16 is negative, the control returns back to S15. Specifically, the operations of the intake and exhaust second direction switch valves 46 and 47 are prohibited until the current phase angles become the target phase angles.

If the determination result at S16 is positive, the control proceeds to S17 where the intake and exhaust second direction switch valves 46 and 47 are operated and the dual-cylinder operation (reduced-cylinder operation) is performed.

Here, if the engine 2 is stopped, the oil flows out of the advance-side operation chambers 207 and the retard-side operation chambers 208 of the VVT 33 and they become empty. At this point, if the lock pin 231 is not fitted in the recessed fitting portion 202*b*, when the engine 2 is started next time, the vane body 202 flips around and collides with the housing 201, which causes noise.

Therefore, to prevent the occurrence of such noise, when the controller 100 receives an engine stop signal from an ignition switch of the vehicle and stops the engine 2 due to the ignition switch being turned off, if the phase angle of the camshaft 19 with respect to the crankshaft 9 is not the specific phase angle (the most-advanced phase angle in the VVT 33), the controller 100, immediately before stopping the engine 2, controls the phase angle of the camshaft 19 with respect to the crankshaft 9 to be the specific phase angle so as to resume the lock pin 231 to the locked state by using the elastic biasing force of the lock pin biasing string 233, and then the controller 100 stops the engine 2.

To realize such a configuration, in starting the engine 2, the lock pin 231 is unlocked first, and then the VVT 33 is operated. However, the oil needs to be charged into the advance-side operation chambers 207 and the retard-side operation chambers 208 of the VVT 33 before the lock pin 231 is unlocked.

Figure 14:
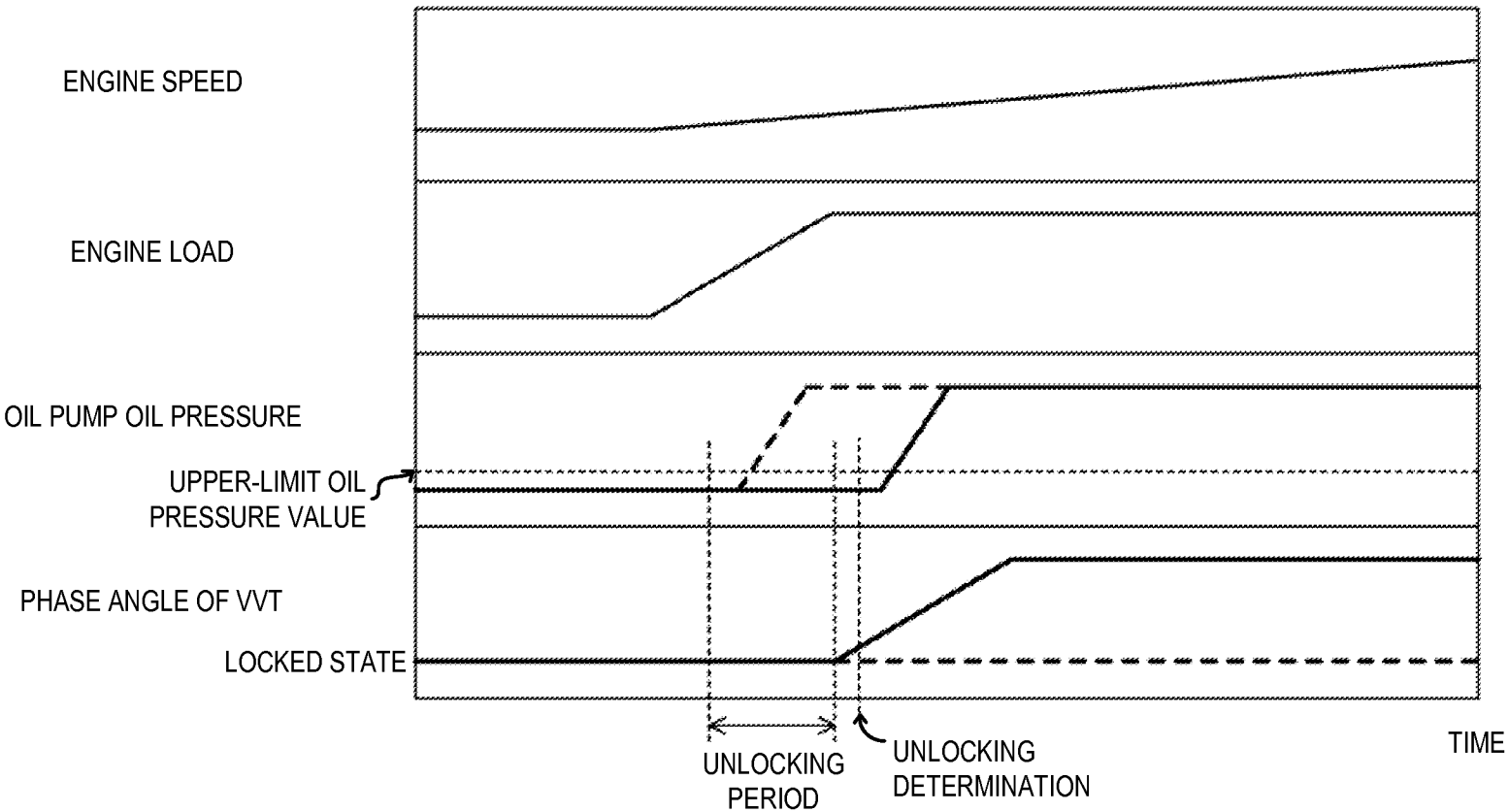
FIG. 14 is a time chart illustrating changes of an engine speed, an engine load, a supplied oil pressure from the oil pump, and a phase angle of the exhaust variable valve timing mechanism over time in an idle operation.

FIG. 14 is a time chart illustrating changes of the engine speed, the engine load, the supplied oil pressure from the oil pump 36, and the phase angle of the VVT 33 over time in an idle operation (specific operation).

In a case where the engine load is increased during the idle operation, the supplied oil pressure from the oil pump 36 ("oil pump oil pressure" in FIG. 14) is increased with high responsiveness (instantly) by the control of the oil discharge amount of the oil pump 36 described above (the combination of the feedforward control of the duty ratio and the feedback control of the oil pressure), as indicated by the dashed line in FIG. 14. Therefore, when the engine load is increased during the idle operation in which the lock pin 231 is in the locked state, if the lock pin 231 is unlocked in the state where the oil is charged into the advance-side operation chambers 207 and the retard-side operation chambers 208 of the VVT 33, the oil is supplied to the retard-side operation chambers 208 by a high oil pressure due to the control of the exhaust first direction switch valve 35. Thus, there may be a case where the vane body 202 attempts to turn in the opposite direction to the rotational direction of the camshaft 19 while unlocking the lock pin 231, the turning force of the vane body 202 acts on the lock pin 231 as a shearing force, and the lock pin 231 cannot be unlocked.

Therefore, in this embodiment, when the engine load is increased during the idle operation in which the lock pin 231 is in the locked state, in unlocking the lock pin 231, instead of the control of the discharge amount of the oil pump 36 described above (the control for adjusting the oil discharge amount of the oil pump 36 so that the oil pressure detected by the oil pressure sensor 70 becomes the target oil pressure which is set beforehand according to the operating state of the engine 2 (hereinafter, referred to as the target oil pressure control)), a discharge amount restricting control for restricting the oil discharge amount of the oil pump 36 so that the oil pressure detected by the oil pressure sensor 70 becomes an upper-limit oil pressure value or lower, which is the upper limit for the lock pin 231 to be unlocked, is performed (see the solid line in FIG. 14). The upper-limit oil pressure value is smaller than the required oil pressure of the valve stopping mechanisms 25*b*.

Hereinafter, the discharge amount restricting control of the oil pump 36 when the engine load is increased during the idle operation is described in detail.

When the engine load is increased during the idle operation, while unlocking the lock pin 231, the controller 100 determines whether the unlocking of the lock pin 231 is completed based on the detection information from the cam angle sensor 74. Here, if the phase angle of the VVT 33 corresponding to the cam angle read from the cam angle sensor 74 is changed, the unlocking of the lock pin 231 is determined to be completed ("unlocked determination" in FIG. 14). Until the unlocking of the lock pin 231 is determined to be completed, the controller 100 performs the discharge amount restricting control instead of the target oil pressure control. In the discharge amount restricting control, for example, the oil discharge amount of the oil pump 36 is controlled so that the oil pressure detected by the oil pressure sensor 70 is kept at the oil pressure value immediately before the unlocking of the lock pin 231 is started (immediately before the unlocking period starts). Then, immediately after the unlocking of the lock pin 231 is determined to be completed, the controller 100 switches the discharge amount restricting control into the target oil pressure control.

Figure 15:
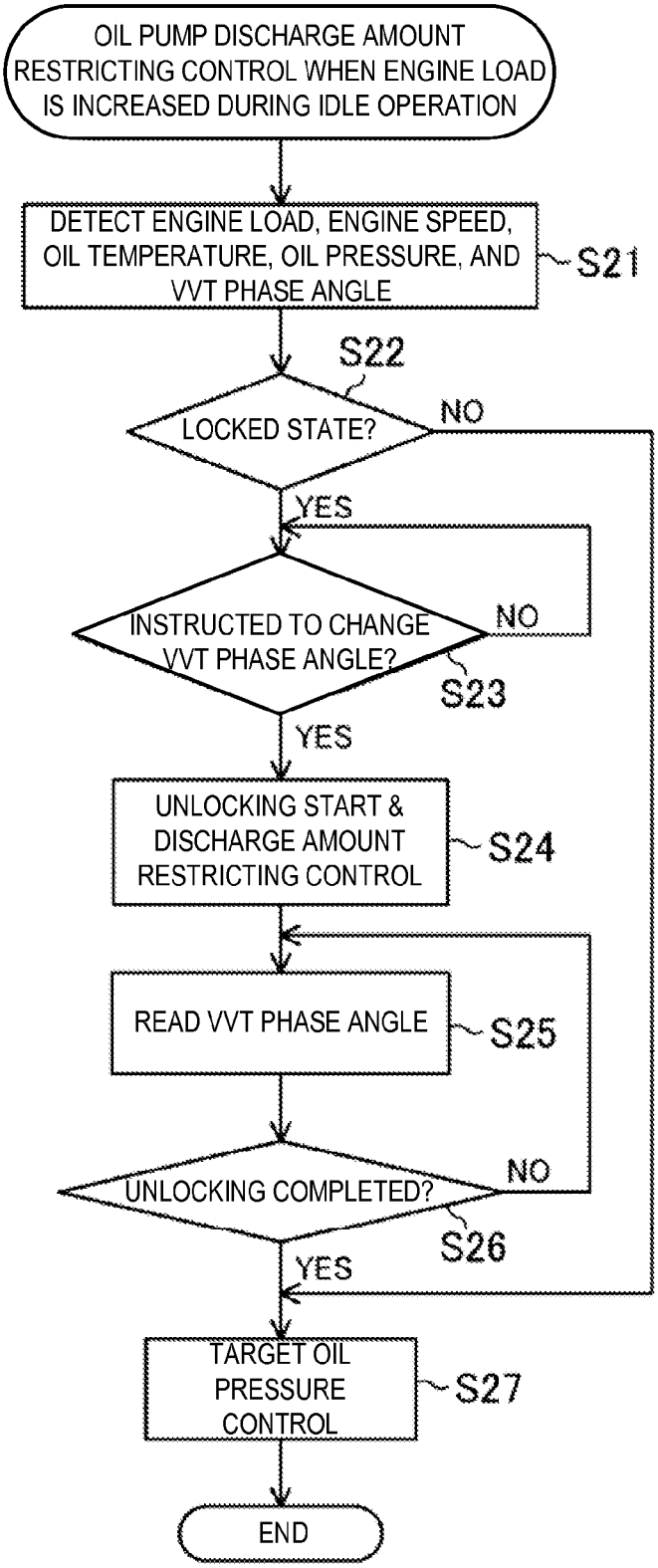
FIG. 15 is a flowchart illustrating a discharge amount restricting control operation of the oil pump performed by a controller when the engine load is increased during the idle operation.

The operation of the discharge amount restricting control of the oil pump 36 performed by the controller 100 when the engine load is increased during the idle operation is described according to the flowchart in FIG. 15.

First, at S21, to grasp the operating state of the engine 2, the detection information are read from the various sensors to detect the engine load, the engine speed, the oil temperature, the oil pressure, the phase angles of the VVTs 32 and 33, and the like. Next, at S22, whether the lock pin 231 is currently in the locked state is determined.

If the determination result at S22 is negative, the control proceeds to S27 where the target oil pressure control for adjusting the oil discharge amount of the oil pump 36 is continued so that the oil pressure to be detected by the oil pressure sensor 70 becomes the target oil pressure which is set beforehand according to the operating state of the engine 2, and then the current control operation is terminated. On the other hand, if the determination result at S22 is positive, the control proceeds to S23 where whether a change instruction of the phase angle of the VVT 33 is currently issued is determined.

If the determination result at S23 is negative, the operation at S23 is repeated. On the other hand, if the determination result at S23 is positive, the control proceeds to S24 where the unlocking of the lock pin 231 is started and the discharge amount restricting control, which restricts the oil discharge amount of the oil pump 36 so that the oil pressure to be detected by the oil pressure sensor 70 becomes a pressure which is between the required oil pressure of the VVT 33 and the upper-limit oil pressure value, which is the upper limit for the lock pin 231 to be unlocked, is performed instead of the target oil pressure control.

Following S24, at S25, the current phase angle of the VVT 33 is read. Next at S26, whether the unlocking of the lock pin 231 is completed is determined based on the read phase angle of the VVT 33. If the determination result at S26 is negative, the control returns to S25. On the other hand, if the determination result at S26 is positive, the control proceeds to S27 where the discharge amount restricting control is switched into the target oil pressure control, and then the current control operation is terminated.

-Effects-

Thus, according to this embodiment, the controller 100 performs the target oil pressure control for adjusting the oil discharge amount of the oil pump 36 so that the oil pressure to be detected by the oil pressure sensor 70 becomes the target oil pressure which is set beforehand according to the operating state of the engine 2. Thus, a suitable phase angle control according to the operating state of the engine 2 can be performed.

Moreover, when the engine load is increased during the idle operation in which the lock pin 231 of the VVT 33 is in the locked state, in the unlocking operation of the lock pin 231, the controller 100 performs, instead of the target oil pressure control, the discharge amount restricting control for restricting the oil discharge amount of the oil pump 36 so that the oil pressure to be detected by the oil pressure sensor 70 becomes the upper-limit oil pressure value or lower, which is the upper limit for the lock pin 231 to be unlocked. Thus, the unlocking failure of the lock pin 231 of the VVT 33 can be reduced.

Thus, the unlocking failure of the lock pin 231 of the VVT 33 can be reduced while performing a suitable phase angle control according to the operating state of the engine 2.

Moreover, when the engine load is increased during the idle operation, while the unlocking operation of the lock pin 231 of the VVT 33 is performed, the controller 100 determines whether the unlocking operation of the lock pin 231 is completed based on the detection information from the cam angle sensor 74, and until the unlocking operation of the lock pin 231 is determined to be completed, the discharge amount restricting control is performed instead of the target oil pressure control. Thus, until the unlocking operation of the lock pin 231 is completed, the oil pressure to be detected by the oil pressure sensor 70 can surely be the upper-limit oil pressure value or lower, which is the upper limit for the unlocking operation of the lock pin 231 to be performed. Therefore, the unlocking failure of the lock pin 231 can surely be reduced.

Further, the valve stopping mechanisms 25*b* suspend the operations of the first and fourth cylinders of the engine 2 by the oil pressure supply, so as to perform the reduced-cylinder operation of the engine 2. Moreover, during the reduced-cylinder operation of the engine 2, the controller 100 performs the target oil pressure control so that the oil pressure to be detected by the oil pressure sensor 70 becomes the target oil pressure, which is higher than the required oil pressure of the valve stopping mechanisms 25*b*. Therefore, the valve stopping mechanisms 25*b* can be stably operated and the reduced-cylinder operation can be maintained stable. Thus, the fuel consumption efficiency can be improved.

(Other Embodiments)

The present invention is not limited to the above embodiment, and may be substituted without deviating from the scope of the following claims.

For example, in the above embodiment, the electric variable valve timing mechanism which is driven by a motor is used as the intake variable valve timing mechanism; however, instead of this, a hydraulically-operated variable valve timing mechanism may be used similarly as the exhaust variable valve timing mechanism. In this case, when the engine load is increased during the idle operation, while also unlocking the lock pin of the intake variable valve timing mechanism, the discharge amount restricting control may be performed instead of the target oil pressure control.

Moreover, in the above embodiment, the discharge amount restricting control is performed instead of the target oil pressure control when the engine load is increased; however, when the engine speed is also increased, the discharge amount restricting control may be performed instead of the target oil pressure control.

Figure 16:
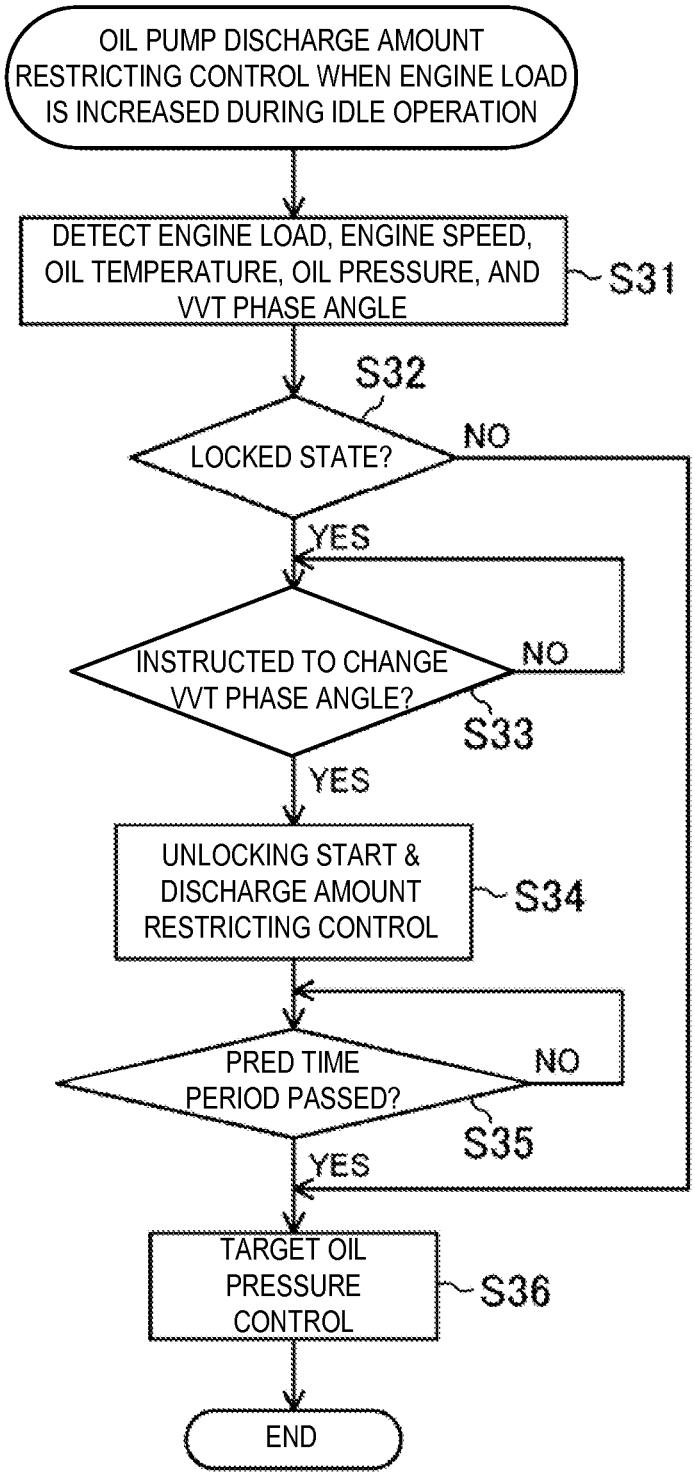
FIG. 16 is a flowchart illustrating a discharge amount restricting control operation of the oil pump performed by a controller when the engine load is increased during the idle operation according a modification of the embodiment.

Furthermore, in the above embodiment, until the unlocking of the lock pin 231 is determined to be completed, the discharge amount restricting control is performed instead of the target oil pressure control; however, instead of this, when the engine load is increased during the idle operation, the discharge amount restricting control may be performed instead of the target oil pressure control for a predetermined period of time since the start of the unlocking of the lock pin 231. The operation of the discharge amount restricting control of the oil pump 36 performed by the controller 100 when the engine load is increased during the idle operation in such a case is described according to the flowchart in FIG. 16.

The description of the operations at S31 to S34 and S36 is omitted since similar operations at S21 to S24 and S27 described above are performed, respectively.

At S35, whether the predetermined time period has passed since the start of the unlocking of the lock pin 231 is determined. If the determination result at S35 is negative, then the operation at S35 is repeated. On the other hand, if the determination result at S35 is positive, then the unlocking of the lock pin 231 is considered to be completed (unlocking period ends) and the control proceeds to S36 where the discharge amount restricting control is switched into the target oil pressure control, and then the current control operation is terminated.

In this manner, since the controller 100 performs the discharge amount restricting control instead of the target oil pressure control for the predetermined time period since the start of the unlocking operation of the lock pin 231 of the VVT 33 when the engine load is increased during the idle operation, the unlocking failure of the lock pin 231 can be reduced with a simple configuration using a timer.

Moreover, in the above embodiment, the variable displacement oil pump which is driven by the engine 2 is used as the variable oil pump; however, instead of this, an electric oil pump which is driven by the motor may be used and a pump control device for controlling an oil discharge amount of the electric oil pump to be the target oil pressure by controlling a speed thereof may be provided. In this case, the oil discharge amount can be calculated based on the speed of the electric oil pump discharging a predetermined volume of oil.

The above-described embodiment is merely instantiation and therefore, the scope of the present invention must not be interpreted in a limited way thereby. The scope of the present invention is defined by the following claims, and all of the modifications and changes falling under the equivalent range of the claims are within the scope of the present invention.

The present invention is useful for a control system for an engine, which includes a hydraulically-operated variable valve timing mechanism and a variable oil pump. The hydraulically-operated variable valve timing mechanism is one of hydraulically-operated devices and has advance-side and retard-side operation chambers for changing a phase angle of a camshaft with respect to a crankshaft by supplying hydraulic pressure, and a locking mechanism which unlocks, by supplying hydraulic pressure, a locking member for fixing the phase angle of the camshaft with respect to the crankshaft. The variable oil pump supplies oil to the hydraulically-operated devices of the engine, including the variable timing mechanism of the engine, via a hydraulic-pressure path.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2 Engine
9 Crankshaft
14 Intake Valve
15 Exhaust Valve
18 Intake Camshaft
19 Exhaust Camshaft
25 Hydraulic Lash Adjuster with Valve Stopping Mechanism
25*a* Pivot Mechanism
25*b* Valve Stopping Mechanism (Hydraulically-operated Device)
32 Intake Variable Valve Timing Mechanism
33 Exhaust Variable Valve Timing Mechanism (Hydraulically-operated Device)
35 Exhaust First Direction Switch Valve (Oil Pressure Control Valve)
36 Variable Displacement Oil Pump (Variable Oil Pump)
70 Oil Pressure Sensor
74 Cam Angle Sensors
100 Controller (Pump Control Device)
230 Locking Mechanism
231 Lock Pin (Locking Member)

What is claimed is:

1. A control system for an engine, the control system including a hydraulically-operated variable valve timing mechanism, a variable oil pump, and a hydraulic-pressure control valve, the hydraulically-operated variable valve timing mechanism having advance-side and retard-side operation chambers that are formed by a housing for rotating in cooperation with a crankshaft of the engine and a vane body for integrally rotating with a camshaft, and change a phase angle of the camshaft with respect to the crankshaft by supplying hydraulic pressure, and a locking mechanism including a locking member, the locking mechanism unlocking, by supplying hydraulic pressure, the locking member to fix the phase angle of the camshaft with respect to the crankshaft, the variable oil pump supplying, via a hydraulic-pressure path, oil to hydraulically-operated devices including the variable valve timing mechanism of the engine, the hydraulic-pressure control valve controlling the hydraulic pressure to be supplied to the locking mechanism and the advance-side and retard-side operation chambers, the control system comprising:

a hydraulic-pressure sensor for detecting the hydraulic pressure within the hydraulic-pressure path; and a pump control device for performing a target hydraulic-pressure control for controlling an oil discharge amount of the variable oil pump to control the hydraulic pressure that is to be detected by the hydraulic-pressure sensor to be a target hydraulic pressure set according to an operating state of the engine, wherein during a change of the operating state of the engine in a specific operation of the engine in which the locking member of the locking mechanism is in a locked state, while an unlocking operation of the locking member is performed, the pump control device performs, instead of the target hydraulic-pressure control, a discharge amount restricting control for restricting the oil discharge amount of the variable oil pump to control the hydraulic pressure that is to be detected by the hydraulic-pressure sensor up to and including an upper-limit hydraulic-pressure value, the upper-limit hydraulic-pressure value being an upper limit for the unlocking operation of the locking member to be performed.

2. The control system of claim 1, further comprising a cam angle sensor for detecting a rotational phase of the camshaft, wherein when an engine load is increased in the change of the operating state of the engine during the specific operation of the engine, while the unlocking operation of the locking member of the locking mechanism is performed, the pump control device determines, based on detection information from the cam angle sensor, whether the unlocking operation of the locking member is completed, and until the unlocking operation of the locking member is determined to be completed, the pump control device performs the discharge amount restricting control instead of the target hydraulic-pressure control.

3. The control system of claim 2, wherein the hydraulically-operated devices further include a hydraulically-operated valve stopping mechanism for performing a reduced-cylinder operation of the engine by supplying hydraulic pressure to suspend one or more of cylinders of the engine, the one or more of the cylinders being less than all the cylinders, and wherein in the reduced-cylinder operation of the engine, the pump control device performs the target hydraulic-pressure control to control the hydraulic pressure that is to be detected by the hydraulic-pressure sensor to be a target hydraulic pressure higher than a required hydraulic pressure of the valve stopping mechanism.

4. The control system of claim 1, wherein when an engine load is increased in the change of the operating state of the engine during the specific operation of the engine, the pump control device performs the discharge amount restricting control instead of the target hydraulic-pressure control for a predetermined period of time from a start of the unlocking operation of the locking member of the locking mechanism.

5. The control system of claim 4, wherein the hydraulically-operated devices include a hydraulically-operated valve stopping mechanism for performing a reduced-cylinder operation of the engine by supplying hydraulic pressure to suspend one or more of cylinders of the engine, the one or more of the cylinders being less than all the cylinders, and wherein in the reduced-cylinder operation of the engine, the pump control device performs the target hydraulic-pressure control to control the hydraulic pressure that is to be detected by the hydraulic-pressure sensor to be a target hydraulic pressure higher than a required hydraulic pressure of the valve stopping mechanism.

6. The control system of claim 1, wherein the hydraulically-operated devices further include a hydraulically-operated valve stopping mechanism for performing a reduced-cylinder operation of the engine by supplying the hydraulic pressure to suspend one or more of cylinders of the engine, the one or more of the cylinders being less than all the cylinders, and wherein in the reduced-cylinder operation of the engine, the pump control device performs the target hydraulic-pressure control to control the hydraulic pressure that is to be detected by the hydraulic-pressure sensor to be a target hydraulic pressure higher than a required hydraulic pressure of the valve stopping mechanism.

* * * * *